US007264048B2

(12) United States Patent
Zupanick et al.

(10) Patent No.: US 7,264,048 B2
(45) Date of Patent: Sep. 4, 2007

(54) SLOT CAVITY

(75) Inventors: Joseph A. Zupanick, Pineville, WV (US); Monty H. Rial, Dallas, TX (US)

(73) Assignee: CDX Gas, LLC, Dallas, TX (US)

( * ) Notice: Subject to any disclaimer, the term of this patent is extended or adjusted under 35 U.S.C. 154(b) by 2 days.

(21) Appl. No.: 10/419,529

(22) Filed: Apr. 21, 2003

(65) Prior Publication Data

US 2004/0206493 A1 Oct. 21, 2004

(51) Int. Cl.
*E21B 43/30* (2006.01)

(52) U.S. Cl. ..... 166/245; 166/50; 166/52; 175/62; 405/55

(58) Field of Classification Search ..... 166/50, 166/52, 54.1, 245, 313; 175/19, 53, 61, 62, 175/263, 266; 405/55; 299/19
See application file for complete search history.

(56) References Cited

U.S. PATENT DOCUMENTS

| | | | | |
|---|---|---|---|---|
| 54,144 | A | 4/1866 | Hamar | 175/263 |
| 274,740 | A | 3/1883 | Douglass | |
| 526,708 | A | 10/1894 | Horton | |
| 639,036 | A | 12/1899 | Heald | 175/263 |
| 1,189,560 | A | 7/1916 | Gondos | 175/265 |
| 1,285,347 | A | 11/1918 | Otto | 175/263 |
| 1,467,480 | A | 9/1923 | Hogue | 175/263 |
| 1,485,615 | A | 3/1924 | Jones | 175/263 |
| 1,488,106 | A | 3/1924 | Fitzpatrick | |
| 1,498,463 | A | 6/1924 | McCloskey et al. | |
| 1,520,737 | A | 12/1924 | Wright | |
| 1,589,508 | A | 6/1926 | Boynton | |
| 1,674,392 | A | 6/1928 | Flansburg | |
| 1,710,998 | A | 4/1929 | Rudkin | |

(Continued)

FOREIGN PATENT DOCUMENTS

AU 85/49964 A 11/1986

(Continued)

OTHER PUBLICATIONS

Notification of Transmittal of the International Search Report or the Declaration (PCT Rule 44.1) mailed Sep. 2, 2003 (8 pages) re International Application No. PCT/US 03/14828, May 12, 2003.

(Continued)

*Primary Examiner*—Kenneth Thompson
(74) *Attorney, Agent, or Firm*—Fish & Richardson P.C.

(57) ABSTRACT

A method for accessing a subterranean zone from the surface includes drilling a substantially vertical well bore from the surface to the subterranean zone and forming a slot cavity in the substantially vertical well bore proximate to the subterranean zone. The slot cavity comprises a substantially non-cylindrical shape. The method also includes drilling an articulated well bore from the surface to the subterranean zone. The articulated well bore is horizontally offset from the substantially vertical well bore at the surface and intersects the substantially vertical well bore at a junction proximate to the subterranean zone. The method may include drilling the articulated well bore to intersect the slot cavity of the substantially vertical well bore and drilling a substantially horizontal drainage pattern from the slot cavity into the subterranean zone. The subterranean zone may comprise a coal seam.

27 Claims, 8 Drawing Sheets

U.S. PATENT DOCUMENTS

| | | | | | |
|---|---|---|---|---|---|
| 1,777,961 | A | | 10/1930 | Capeliuschnicoff | |
| 1,970,063 | A | | 8/1934 | Steinman | 255/74 |
| 2,018,285 | A | | 10/1935 | Schweitzer et al. | |
| 2,031,353 | A | | 2/1936 | Woodruff | 255/76 |
| 2,069,482 | A | | 2/1937 | Seay | 255/76 |
| 2,150,228 | A | | 3/1939 | Lamb | 166/10 |
| 2,169,502 | A | | 8/1939 | Santiago | 255/76 |
| 2,169,718 | A | | 8/1939 | McGowen, Jr. et al. | 255/24 |
| 2,290,502 | A | | 7/1942 | Squires | 255/76 |
| 2,335,085 | A | | 11/1943 | Roberts | |
| 2,450,223 | A | | 9/1948 | Barbour | 255/76 |
| 2,490,350 | A | | 12/1949 | Grable | 166/4 |
| 2,679,903 | A | | 6/1954 | McGowen, Jr. et al. | |
| 2,726,063 | A | | 12/1955 | Ragland et al. | |
| 2,726,847 | A | | 12/1955 | McCune et al. | |
| 2,783,018 | A | | 2/1957 | Lytle | |
| 2,797,893 | A | | 7/1957 | McCune et al. | |
| 2,847,189 | A | | 8/1958 | Shook | 255/76 |
| 2,911,008 | A | | 11/1959 | Du Bois | |
| 2,934,904 | A | * | 5/1960 | Hendrix | 405/59 |
| 2,980,142 | A | | 4/1961 | Turak | |
| 3,087,552 | A | | 4/1963 | Graham | |
| 3,126,065 | A | | 3/1964 | Chadderdon | |
| 3,163,211 | A | | 12/1964 | Henley | |
| 3,208,537 | A | | 9/1965 | Scarborough | |
| 3,339,647 | A | | 9/1967 | Kammerer, Jr. | 175/268 |
| 3,347,595 | A | | 10/1967 | Dahms et al. | |
| 3,379,266 | A | | 4/1968 | Fletcher | 175/285 |
| 3,385,382 | A | | 5/1968 | Canalizo et al. | |
| 3,397,750 | A | | 8/1968 | Wicklund | 175/18 |
| 3,443,648 | A | | 5/1969 | Howard | 175/103 |
| 3,473,571 | A | | 10/1969 | Dugay | |
| 3,503,377 | A | | 3/1970 | Beatenbough et al. | |
| 3,528,516 | A | | 9/1970 | Brown | 175/267 |
| 3,530,675 | A | | 9/1970 | Turzillo | |
| 3,534,822 | A | | 10/1970 | Campbell et al. | |
| 3,578,077 | A | | 5/1971 | Glenn, Jr. et al. | |
| 3,582,138 | A | | 6/1971 | Loofburow et al. | |
| 3,587,743 | A | | 6/1971 | Howard | |
| 3,684,041 | A | | 8/1972 | Kammerer, Jr. et al. | 175/267 |
| 3,687,204 | A | | 8/1972 | Marshall et al. | |
| 3,692,041 | A | | 9/1972 | Bondi | |
| 3,744,565 | A | | 7/1973 | Brown | |
| 3,757,876 | A | | 9/1973 | Pereau | 175/267 |
| 3,757,877 | A | | 9/1973 | Leathers | 175/269 |
| 3,759,328 | A | | 9/1973 | Ueber et al. | |
| 3,763,652 | A | | 10/1973 | Rinta | |
| 3,800,830 | A | | 4/1974 | Etter | |
| 3,809,519 | A | | 5/1974 | Garner | |
| 3,825,081 | A | | 7/1974 | McMahon | |
| 3,828,867 | A | | 8/1974 | Elwood | |
| 3,874,413 | A | | 4/1975 | Valdez | |
| 3,887,008 | A | | 6/1975 | Canfield | |
| 3,902,322 | A | | 9/1975 | Watanabe | |
| 3,907,045 | A | | 9/1975 | Dahl et al. | |
| 3,934,649 | A | | 1/1976 | Pasini, III et al. | |
| 3,957,082 | A | | 5/1976 | Fuson et al. | |
| 3,961,824 | A | | 6/1976 | Van Eek et al. | |
| 4,011,890 | A | | 3/1977 | Andersson | |
| 4,020,901 | A | | 5/1977 | Pisio et al. | |
| 4,022,279 | A | | 5/1977 | Driver | |
| 4,030,310 | A | | 6/1977 | Schirtzinger | |
| 4,037,658 | A | | 7/1977 | Anderson | |
| 4,060,130 | A | | 11/1977 | Hart | |
| 4,073,351 | A | | 2/1978 | Baum | 175/14 |
| 4,089,374 | A | | 5/1978 | Terry | |
| 4,116,012 | A | | 9/1978 | Abe et al. | |
| 4,134,463 | A | | 1/1979 | Allen | |
| 4,136,996 | A | | 1/1979 | Burns | |
| 4,151,880 | A | | 5/1979 | Vann | 166/314 |
| 4,156,437 | A | | 5/1979 | Chivens et al. | |
| 4,158,388 | A | | 6/1979 | Owen et al. | 166/286 |
| 4,169,510 | A | | 10/1979 | Meigs | 175/65 |
| 4,182,423 | A | | 1/1980 | Ziebarth et al. | |
| 4,189,184 | A | | 2/1980 | Green | 299/8 |
| 4,220,203 | A | | 9/1980 | Steeman | |
| 4,221,433 | A | | 9/1980 | Jacoby | |
| 4,222,611 | A | | 9/1980 | Larson et al. | |
| 4,224,989 | A | | 9/1980 | Blount | |
| 4,226,475 | A | * | 10/1980 | Frosch et al. | 299/13 |
| 4,243,099 | A | | 1/1981 | Rodgers, Jr. | 166/65 R |
| 4,257,650 | A | | 3/1981 | Allen | |
| 4,278,137 | A | | 7/1981 | Van Eek | 175/267 |
| 4,283,088 | A | | 8/1981 | Tabakov et al. | |
| 4,296,785 | A | | 10/1981 | Vitello et al. | |
| 4,299,295 | A | | 11/1981 | Gossard | |
| 4,303,127 | A | | 12/1981 | Freel et al. | |
| 4,305,464 | A | | 12/1981 | Masszi | |
| 4,312,377 | A | | 1/1982 | Knecht | |
| 4,317,492 | A | | 3/1982 | Summers et al. | |
| 4,323,129 | A | | 4/1982 | Cordes | |
| 4,328,577 | A | | 5/1982 | Abbott et al. | |
| 4,333,539 | A | | 6/1982 | Lyons et al. | |
| 4,356,866 | A | | 11/1982 | Savins | |
| 4,366,988 | A | | 1/1983 | Bodine | 299/14 |
| 4,372,398 | A | | 2/1983 | Kuckes | |
| 4,386,665 | A | | 6/1983 | Dellinger | |
| 4,390,067 | A | | 6/1983 | Willman | |
| 4,396,075 | A | | 8/1983 | Wood et al. | |
| 4,396,076 | A | | 8/1983 | Inoue | 175/265 |
| 4,397,360 | A | | 8/1983 | Schmidt | |
| 4,401,171 | A | | 8/1983 | Fuchs | 175/267 |
| 4,407,376 | A | | 10/1983 | Inoue | 175/267 |
| 4,415,205 | A | | 11/1983 | Rehm et al. | |
| 4,417,829 | A | | 11/1983 | Berezoutzky | |
| 4,422,505 | A | * | 12/1983 | Collins | 166/256 |
| 4,437,706 | A | | 3/1984 | Johnson | |
| 4,442,896 | A | | 4/1984 | Reale et al. | |
| 4,463,988 | A | | 8/1984 | Bouck et al. | |
| 4,494,616 | A | | 1/1985 | McKee | 175/67 |
| 4,502,733 | A | | 3/1985 | Grubb | |
| 4,512,422 | A | | 4/1985 | Knisley | |
| 4,519,463 | A | | 5/1985 | Schuh | |
| 4,527,639 | A | | 7/1985 | Dickinson, III et al. | |
| 4,532,986 | A | | 8/1985 | Mims et al. | |
| 4,533,182 | A | | 8/1985 | Richards | |
| 4,536,035 | A | | 8/1985 | Huffman et al. | |
| 4,544,037 | A | | 10/1985 | Terry | |
| 4,549,630 | A | | 10/1985 | Brown | 181/106 |
| 4,558,744 | A | | 12/1985 | Gibb | 166/335 |
| 4,565,252 | A | | 1/1986 | Campbell et al. | 175/269 |
| 4,573,541 | A | | 3/1986 | Josse et al. | |
| 4,600,061 | A | | 7/1986 | Richards | |
| 4,603,592 | A | | 8/1986 | Siebold et al. | |
| 4,605,076 | A | | 8/1986 | Goodhart | |
| 4,611,855 | A | | 9/1986 | Richards | |
| 4,618,009 | A | | 10/1986 | Carter et al. | 175/267 |
| 4,638,949 | A | | 1/1987 | Mancel | |
| 4,646,836 | A | | 3/1987 | Goodhart | |
| 4,651,836 | A | | 3/1987 | Richards | |
| 4,662,440 | A | | 5/1987 | Harmon et al. | |
| 4,674,579 | A | | 6/1987 | Geller et al. | 175/45 |
| 4,676,313 | A | | 6/1987 | Rinaldi | |
| 4,702,314 | A | | 10/1987 | Huang et al. | |
| 4,705,109 | A | | 11/1987 | Ledent et al. | |
| 4,705,431 | A | | 11/1987 | Gadelle et al. | |
| 4,715,440 | A | | 12/1987 | Boxell et al. | 166/100 |
| 4,718,485 | A | | 1/1988 | Brown et al. | |
| RE32,623 | E | | 3/1988 | Marshall et al. | |
| 4,727,937 | A | | 3/1988 | Shum et al. | |
| 4,753,485 | A | | 6/1988 | Goodhart | |
| 4,754,808 | A | | 7/1988 | Harmon et al. | |
| 4,754,819 | A | | 7/1988 | Dellinger | |
| 4,756,367 | A | | 7/1988 | Puri et al. | |

4,763,734 A 8/1988 Dickinson et al.
4,773,488 A 9/1988 Bell et al.
4,776,638 A 10/1988 Hahn
4,830,105 A 5/1989 Petermann ..... 166/241
4,832,122 A 5/1989 Corey et al.
4,836,611 A 6/1989 El-Saie
4,842,081 A 6/1989 Parant
4,844,182 A 7/1989 Tolle
4,852,666 A 8/1989 Brunet et al.
4,883,122 A 11/1989 Puri et al.
4,887,668 A 12/1989 Lynde ..... 166/55.8
4,889,186 A 12/1989 Hanson et al.
4,978,172 A 12/1990 Schwoebel et al.
5,016,709 A 5/1991 Combe et al.
5,016,710 A * 5/1991 Renard et al. ..... 166/245
5,033,550 A 7/1991 Johnson et al.
5,035,605 A 7/1991 Dinerman et al.
5,036,921 A 8/1991 Pittard et al. ..... 166/298
5,074,360 A 12/1991 Guinn
5,074,365 A 12/1991 Kuckes
5,074,366 A 12/1991 Karlsson et al.
5,082,054 A 1/1992 Kiamanesh
5,111,893 A 5/1992 Kvello-Aune
5,115,872 A 5/1992 Brunet et al.
5,127,457 A 7/1992 Stewart et al.
5,135,058 A 8/1992 Millgard et al. ..... 175/71
5,148,875 A 9/1992 Karlsson et al. ..... 175/62
5,148,877 A 9/1992 MacGregor
5,165,491 A 11/1992 Wilson
5,168,942 A 12/1992 Wydrinski
5,174,374 A 12/1992 Hailey
5,193,620 A 3/1993 Braddick
5,194,859 A 3/1993 Warren
5,197,553 A 3/1993 Leturno ..... 175/57
5,197,783 A 3/1993 Theimer et al.
5,199,496 A 4/1993 Redus et al.
5,201,817 A 4/1993 Hailey ..... 175/269
5,207,271 A 5/1993 Sanchez et al.
5,217,076 A 6/1993 Masek
5,226,495 A 7/1993 Jennings, Jr.
5,240,350 A 8/1993 Yamaguchi et al.
5,242,017 A 9/1993 Hailey ..... 166/55.8
5,242,025 A 9/1993 Neill et al.
5,246,273 A 9/1993 Rosar
5,255,741 A 10/1993 Alexander ..... 166/278
5,271,472 A 12/1993 Leturno ..... 175/107
5,287,926 A 2/1994 Grupping
5,289,888 A 3/1994 Talley
5,301,760 A 4/1994 Graham
5,343,965 A 9/1994 Talley et al.
5,348,091 A 9/1994 Tchakarov et al. ..... 166/217
5,355,967 A 10/1994 Mueller et al.
5,363,927 A 11/1994 Frank ..... 175/67
5,385,205 A 1/1995 Hailey ..... 166/55.8
5,392,862 A 2/1995 Swearingen ..... 166/386
5,394,950 A 3/1995 Gardes
5,402,851 A 4/1995 Baiton
5,402,856 A 4/1995 Warren ..... 175/57
5,411,082 A 5/1995 Kennedy
5,411,085 A 5/1995 Moore et al.
5,411,088 A 5/1995 LeBlanc et al.
5,411,104 A 5/1995 Stanley
5,411,105 A 5/1995 Gray
5,413,183 A 5/1995 England ..... 175/53
5,431,220 A 7/1995 Lennon et al.
5,431,482 A * 7/1995 Russo ..... 299/4
5,435,400 A 7/1995 Smith
5,447,416 A 9/1995 Wittrisch
5,450,902 A 9/1995 Matthews
5,454,419 A 10/1995 Vloedman
5,458,209 A 10/1995 Hayes et al.
5,462,116 A 10/1995 Carroll
5,462,120 A 10/1995 Gondouin
5,469,155 A 11/1995 Archambeault et al.
5,477,923 A 12/1995 Jordan, Jr. et al.
5,485,089 A 1/1996 Kuckes
5,494,121 A 2/1996 Nackerud ..... 175/263
5,499,687 A 3/1996 Lee ..... 175/317
5,501,273 A 3/1996 Puri
5,501,279 A 3/1996 Garg et al.
5,520,252 A 5/1996 McNair
5,584,605 A 12/1996 Beard et al.
5,613,242 A 3/1997 Oddo
5,615,739 A 4/1997 Dallas
5,653,286 A 8/1997 McCoy et al.
5,664,911 A 9/1997 Bridges et al.
5,669,444 A 9/1997 Riese et al.
5,676,207 A 10/1997 Simon et al.
5,680,901 A 10/1997 Gardes
5,690,390 A 11/1997 Bithell
5,697,445 A 12/1997 Graham
5,706,871 A 1/1998 Andersson et al.
5,720,356 A 2/1998 Gardes
5,722,489 A 3/1998 Lamb et al. ..... 166/269
5,727,629 A 3/1998 Blizzard, Jr. et al.
5,733,067 A 3/1998 Hunt et al.
5,735,350 A 4/1998 Longbottom et al.
5,771,976 A 6/1998 Talley
5,775,433 A 7/1998 Hammett et al.
5,775,446 A 7/1998 Lott
5,785,133 A 7/1998 Murray et al.
5,832,958 A 11/1998 Cheng
5,853,054 A 12/1998 McGarian et al. ..... 175/267
5,853,056 A 12/1998 Landers
5,853,224 A 12/1998 Riese
5,863,283 A 1/1999 Gardes
5,868,202 A 2/1999 Hsu
5,868,210 A 2/1999 Johnson et al.
5,879,057 A 3/1999 Schwoebel et al.
5,884,704 A 3/1999 Longbottom et al.
5,917,325 A 6/1999 Smith
5,934,390 A 8/1999 Uthe
5,938,004 A 8/1999 Roberts et al.
5,941,307 A 8/1999 Tubel
5,941,308 A 8/1999 Malone et al.
5,944,107 A 8/1999 Ohmer
5,957,539 A 9/1999 Durup et al.
5,971,074 A 10/1999 Longbottom et al.
5,988,278 A 11/1999 Johnson
5,992,524 A 11/1999 Graham
6,012,520 A 1/2000 Yu et al.
6,015,012 A 1/2000 Reddick
6,019,173 A 2/2000 Saurer et al.
6,024,171 A 2/2000 Montgomery et al.
6,030,048 A 2/2000 Hsu
6,050,335 A 4/2000 Parsons
6,056,059 A 5/2000 Ohmer
6,062,306 A 5/2000 Gano et al.
6,065,550 A 5/2000 Gardes
6,065,551 A * 5/2000 Gourley et al. ..... 175/291
6,070,677 A 6/2000 Johnston, Jr. ..... 175/57
6,079,495 A 6/2000 Ohmer
6,082,461 A 7/2000 Newman ..... 166/381
6,089,322 A 7/2000 Kelley et al.
6,119,771 A 9/2000 Gano et al.
6,119,776 A * 9/2000 Graham et al. ..... 166/245
6,135,208 A 10/2000 Gano et al.
6,170,571 B1 1/2001 Ohmer
6,179,054 B1 1/2001 Stewart
6,189,616 B1 2/2001 Gano et al.
6,192,988 B1 2/2001 Tubel
6,199,633 B1 3/2001 Longbottom
6,209,636 B1 4/2001 Roberts et al.
6,217,260 B1 4/2001 He ..... 405/237
6,227,312 B1 5/2001 Eppink ..... 175/57
6,237,284 B1 5/2001 Erickson

| | | | | |
|---|---|---|---|---|
| 6,244,340 | B1 | 6/2001 | McGlothen et al. | |
| 6,247,532 | B1 | 6/2001 | Ohmer | |
| 6,263,965 | B1 | 7/2001 | Schmidt et al. | |
| 6,279,658 | B1 | 8/2001 | Donovan et al. | |
| 6,280,000 | B1 * | 8/2001 | Zupanick | 299/12 |
| 6,283,216 | B1 | 9/2001 | Ohmer | |
| 6,318,457 | B1 | 11/2001 | Den Boer et al. | |
| 6,349,769 | B1 | 2/2002 | Ohmer | |
| 6,357,523 | B1 | 3/2002 | Zupanick | |
| 6,357,530 | B1 | 3/2002 | Kennedy et al. | |
| 6,378,626 | B1 | 4/2002 | Wallace | 175/19 |
| 6,412,556 | B1 | 7/2002 | Zupanick | 166/255.2 |
| 6,425,448 | B1 | 7/2002 | Zupanick et al. | |
| 6,439,320 | B2 | 8/2002 | Zupanick | |
| 6,450,256 | B2 | 9/2002 | Mones | |
| 6,454,000 | B1 | 9/2002 | Zupanick | 166/243 |
| 6,457,525 | B1 | 10/2002 | Scott | |
| 6,457,540 | B2 | 10/2002 | Gardes | |
| 6,470,978 | B2 * | 10/2002 | Trueman et al. | 175/67 |
| 6,478,085 | B2 | 11/2002 | Zupanick | |
| 6,491,101 | B2 | 12/2002 | Ohmer | |
| 6,494,272 | B1 | 12/2002 | Eppink et al. | 175/57 |
| 6,497,556 | B2 | 12/2002 | Zupanick et al. | |
| 6,554,063 | B2 | 4/2003 | Ohmer | |
| 6,557,628 | B2 | 5/2003 | Ohmer | |
| 6,561,277 | B2 | 5/2003 | Algeory et al. | |
| 6,561,288 | B2 | 5/2003 | Zupanick | |
| 6,564,867 | B2 | 5/2003 | Ohmer | |
| 6,566,649 | B1 | 5/2003 | Mickael | |
| 6,571,888 | B2 | 6/2003 | Comeau et al. | |
| 6,575,235 | B2 | 6/2003 | Zupanick et al. | |
| 6,575,255 | B1 | 6/2003 | Rial et al. | 175/57 |
| 6,577,129 | B1 | 6/2003 | Thompson et al. | |
| 6,581,455 | B1 | 6/2003 | Berger et al. | |
| 6,581,685 | B2 | 6/2003 | Burgess et al. | |
| 6,585,061 | B2 | 7/2003 | Radzinski et al. | |
| 6,590,202 | B2 | 7/2003 | Mickael | |
| 6,591,903 | B2 | 7/2003 | Ingle et al. | |
| 6,591,922 | B1 | 7/2003 | Rial et al. | 175/288 |
| 6,595,301 | B1 | 7/2003 | Diamond et al. | 175/57 |
| 6,595,302 | B1 | 7/2003 | Diamond et al. | 175/65 |
| 6,598,686 | B1 | 7/2003 | Zupanick | |
| 6,604,580 | B2 | 8/2003 | Zupanick et al. | |
| 6,604,910 | B1 | 8/2003 | Zupanick | |
| 6,607,042 | B2 | 8/2003 | Hoyer et al. | |
| 6,636,159 | B1 | 10/2003 | Winnacker | |
| 6,639,210 | B2 | 10/2003 | Odom et al. | |
| 6,644,422 | B1 | 11/2003 | Rial et al. | 175/57 |
| 6,646,441 | B2 | 11/2003 | Thompson et al. | |
| 6,653,839 | B2 | 11/2003 | Yuratich et al. | |
| 6,662,870 | B1 | 12/2003 | Zupanick et al. | |
| 6,668,918 | B2 | 12/2003 | Zupanick | |
| 6,679,322 | B1 | 1/2004 | Zupanick | |
| 6,681,855 | B2 | 1/2004 | Zupanick et al. | |
| 6,688,388 | B2 | 2/2004 | Zupanick | |
| 6,708,764 | B2 | 3/2004 | Zupanick | |
| 6,725,922 | B2 | 4/2004 | Zupanick | |
| 6,732,792 | B2 | 5/2004 | Zupanick | |
| 6,745,855 | B2 | 6/2004 | Gardes | |
| 6,758,279 | B2 | 7/2004 | Moore et al. | |
| 6,758,289 | B2 | 7/2004 | Kelley et al. | |
| RE38,642 | E | 11/2004 | Gondouin | |
| 2002/0043404 | A1 | 4/2002 | Trueman et al. | |
| 2002/0070052 | A1 | 6/2002 | Armell et al. | |
| 2002/0096336 | A1 | 7/2002 | Zupanick et al. | |
| 2002/0189801 | A1 | 12/2002 | Zupanick et al. | |
| 2003/0066686 | A1 | 4/2003 | Conn | |
| 2003/0075334 | A1 | 4/2003 | Haugen et al. | |
| 2003/0164253 | A1 | 9/2003 | Trueman et al. | |
| 2003/0217842 | A1 | 11/2003 | Zupanick et al. | |
| 2003/0221836 | A1 | 12/2003 | Gardes | |
| 2003/0234120 | A1 | 12/2003 | Paluch et al. | |
| 2004/0007389 | A1 | 1/2004 | Zupanick | |
| 2004/0007390 | A1 | 1/2004 | Zupanick | |
| 2004/0020655 | A1 | 2/2004 | Rusby et al. | |
| 2004/0031609 | A1 | 2/2004 | Zupanick | |
| 2004/0033557 | A1 | 2/2004 | Scott et al. | |
| 2004/0035582 | A1 | 2/2004 | Zupanick | |
| 2004/0050552 | A1 | 3/2004 | Zupanick | |
| 2004/0050554 | A1 | 3/2004 | Zupanick et al. | |
| 2004/0055787 | A1 | 3/2004 | Zupanick | |
| 2004/0060351 | A1 | 4/2004 | Gunter et al. | |
| 2004/0140129 | A1 | 7/2004 | Gardes | |
| 2004/0226719 | A1 | 11/2004 | Morgan et al. | |
| 2005/0133219 | A1 | 6/2005 | Zupanick | |
| 2005/0252689 | A1 | 11/2005 | Gardes | |
| 2005/0257962 | A1 | 11/2005 | Zupanick | |
| 2006/0096755 | A1 | 5/2006 | Zupanick | |

FOREIGN PATENT DOCUMENTS

| | | | |
|---|---|---|---|
| CA | 1067819 | | 12/1979 |
| CA | 2210866 | | 1/1998 |
| CA | 2278735 | | 8/1998 |
| CH | 653741 | A5 | 1/1986 |
| DE | 197 25 996 | A1 | 1/1998 |
| EP | 0 819 834 | A1 | 1/1998 |
| EP | 0 875 661 | A1 | 11/1998 |
| EP | 0 952 300 | A1 | 10/1999 |
| EP | 1 316 673 | A2 | 6/2003 |
| FR | 964503 | | 8/1950 |
| GB | 442008 | | 1/1936 |
| GB | 444484 | | 3/1936 |
| GB | 651468 | | 4/1951 |
| GB | 893869 | | 4/1962 |
| GB | 2 255 033 | A | 10/1992 |
| GB | 2 297 988 | A | 8/1996 |
| GB | 2 347 157 | A | 8/2000 |
| RU | 750108 | | 6/1975 |
| RU | 876968 | | 10/1981 |
| RU | 1448078 | A1 | 3/1987 |
| RU | 1770570 | A1 | 3/1990 |
| UA | 37720 | A | 5/2001 |
| WO | WO 94/21889 | | 9/1994 |
| WO | WO 94/28280 | | 12/1994 |
| WO | WO 97/21900 | | 6/1997 |
| WO | WO 98/25005 | | 6/1998 |
| WO | WO 98/35133 | | 8/1998 |
| WO | WO 99/60248 | | 11/1999 |
| WO | WO 00/31376 | | 6/2000 |
| WO | WO 00/79099 | A1 | 12/2000 |
| WO | WO 01/44620 | A1 | 6/2001 |
| WO | WO 01/83932 | A1 | 11/2001 |
| WO | WO 02/18738 | A1 | 3/2002 |
| WO | WO 02/059455 | A1 | 8/2002 |
| WO | WO 02/061238 | A1 | 8/2002 |
| WO | WO 03/036023 | A1 | 5/2003 |
| WO | WO 03/102348 | A2 | 12/2003 |
| WO | WO 2004/035984 | | 4/2004 |
| WO | WO 2005/003509 | A1 | 1/2005 |

OTHER PUBLICATIONS

Notification of Transmittal of the International Search Report or the Declaration (PCT Rule 44.1) mailed Jul. 4, 2003 (10 pages) re International Application No. PCT/US 03/04771, Jul. 4, 2003.

Notification of Transmittal of the International Search Report or the Declaration (PCT Rule 44.1) mailed Nov. 13, 2003 (8 pages) re International Application No. PCT/US 03/21891, Jul. 4, 2003.

Nackerud Product Desription Received, Sep. 27, 2001.

Rial, Pend. Pat. App., "Pantograph Underreamer," U.S. Appl. No. 10/079,444, Feb. 19, 2002.

Zupanick, Pend Pat App , "Wedge Activated Underreamer," U.S. Appl. No. 10/160,425, May 31, 2002.

Zupanick, Pend. Pat. App. , "Actuator Underreamer," U.S. Appl. No. 10/196,042, May 31, 2002.

Zupanick et al., Pend. Pat. App., "Cavity Positioning Tool," U.S. Appl. No. 10/197,121, Jul. 17, 2002.
Zupanick, Pend. Pat. App., "Cavity Positioning Tool," U.S. Appl. No. 10/188,159, Jul. 1, 2002.
McCray, Arthur, et al., "*Oil Well Drilling Technology,*" University of Oklahoma Press, 1959, Title Page, Copyright Page and pp. 315-319 (7 pages).
Berger, Bill, et al., "*Modern Petroleum: A Basic Primer of the Industry,*" PennWell Books, 1978, Title Page, Copyright Page, and pp. 106-108 (5 pages).
Jones, Arfon H., et al., "*A Review of the Physical and Mechanical Properties of Coal with Implications for Coal-Bed Methane Well Completion and Production,*" Rocky Mountain Association of Geologists, 1988, pp. 169-181 (13 pages).
Hartman, Howard L., et al., "*SME Mining Engineering Handbook,*" Society for Mining, Metallurgy, and Exploration, Inc., 2nd Edition, vol. 2, 1992, Title Page, pp. 1946-1950 (6 pages).
Hassan, Dave, et al., "*Multi-Lateral Technique Lowers Drilling Costs, Provides Environmental Benefits,*" Drilling Technology, Oct. 1999, pp. 41-47 (7 pages).
Ramaswamy, Gopal, "*Production History Provides CMB Insights,*" Oil & Gas Journal, Apr. 2, 2001, pp. 49-50 and 52 (3 pages).
Chi, Weiguo, et al., "*Feasibility of Coalbed Methane Exploitation in China,*" Horizontal Well Technology, Sep. 2001, Title Page and p. 74 (2 pages).
Ramaswamy, Gopal, "*Advances Key For Coalbed Methane,*" The American Oil & Gas Reporter, Oct. 2001, Title Page and pp. 71 and 73 (3 pages).
Stevens, Joseph C., "*Horizontal Applications for Coal Bed Methane Recovery,*" Strategic Research Institute, 3rd Annual Coalbed and Coal Mine Methane Conference, Slides, Mar. 25, 2002, Title Page, Introduction Page and pp. 1-10 (13 pages).
Stayton, R.J. "Bob", "*Horizontal Wells Boost CBM Recovery,*" Special Report: Horizontal and Directional Drilling, The American Oil and Gas Reporter, Aug. 2002, pp. 71, 73-75 (4 pages).
Eaton, Susan, "*Reversal of Fortune: Vertical and Horizontal Well Hybrid Offers Longer Field Life,*" New Technology Magazine, Sep. 2002, pp. 30-31 (2 pages).
Mahony, James, "*A Shadow of Things to Come,*" New Tecnology Magazine, Sep. 2002, pp. 28-29 (2 pages).
Documents Received from Third Party, Great Lakes Directional Drilling, Inc., Sep. 12, 2002, (12 pages).
Taylor, Robert W., et al. "*Multilateral Technologies Increase Operational Efficiencies in Middle East,*" Oil and Gas Journal, Mar. 16, 1998, pp. 76-80 (5 pages).
Pasiczynk, Adam, "*Evolution Simplifies Multilateral Wells,*" Directional Drilling, Jun. 2000, pp. 53-55 (3 pages).
Bell, Steven S. "*Multilateral System with Full Re-Entry Access Installed,*" World Oil, Jun. 1, 1996, p. 29 (1 page).
Jackson, P., et al., "*Reducing Long Term Methane Emissions Resulting from Coal Mining,*" Energy Convers. Mgmt, vol. 37, Nos. 6-8, 1996, pp. 801-806, (6 pages).
Breant, Pascal, "*Des Puits Branches, Chez Total : les puits multi drains,*" Total Exploration Production, Jan. 1999, 11 pages, including translation.
Chi, Weiguo, "*A feasible discussion on exploitation coalbed methane through Horizontal Network Drilling in China,*" SPE 64709, Society of Petroleum Engineers (SPE International), Nov. 7, 2000, 4 pages.
B. Goktas et al., "*Performances of Openhole Completed and Cased Horizontal/Undulating Wells in Thin-Bedded, Tight Sand Gas Reservoirs,*" SPE 65619, Society of Petroleum Engineers, Oct. 17-19, 2000 (7 pages).
Sharma, R., et al., "*Modelling of Undulating Wellbore Trajectories,*" The Journal of Canadian Petroleum Technology, vol. 34, No. 10, XP-002261908, Oct. 18-20, 1993 pp. 16-24 (9 pages).
Balbinski, E.F., "*Prediction of Offshore Viscous Oil Field Performance,*" European Symposium on Improved Oil Recovery, Aug. 18-20, 1999, 10 pages.
Notification of Transmittal of the International Search Report or the Declaration (PCT Rule 44.1) (3 pages) and International Search Report (4 pages) re International Application No. PCT/US 03/21626 mailed Nov. 6, 2003.
Notification of Transmittal of the International Search Report or the Declaration (PCT Rule 44.1) (3 pages) and International Search Report (4 pages) re International Application No. PCT/US 03/38383 mailed Jun. 2, 2004.
Notification of Transmittal of the International Search Report or the Declaration (PCT Rule 44.1) (3 pages) and International Search Report (5 pages) re International Application No. PCT/US 03/21627 mailed Nov. 5, 2003.
Notification of Transmittal of the International Search Report or the Declaration (PCT Rule 44.1) (3 pages) and International Search Report (4 pages) re International Application No. PCT/US 03/21628 mailed Nov. 4, 2003.
Notification of Transmittal of the International Search Report or the Declaration (PCT Rule 44.1) (3 pages) and International Search Report (5 pages) re International Application No. PCT/US 03/21750 mailed Dec. 5, 2003.
Notification of Transmittal of the International Search Report or the Declaration (PCT Rule 44.1) (3 pages) and International Search Report (3 pages) re International Application No. PCT/US 03/28137 mailed Dec. 19, 2003.
Notification of Transmittal of the International Search Report or the Declaration (PCT Rule 44.1) (3 pages) and International Search Report (5 pages) re International Application No. PCT/US 03/26124 mailed Feb. 4, 2004.
Notification of Transmittal of the International Search Report or the Declaration (PCT Rule 44.1) (3 pages) and International Search Report (6 pages) re International Application No. PCT/US 03/28138 mailed Feb. 9, 2004.
Notification of Transmittal of the International Search Report or the Declaration (PCT Rule 44.1) (3 pages) and International Search Report (6 pages) re International Application No. PCT/US-03/30126 mailed Feb. 27, 2004.
Smith, Maurice, "*Chasing Unconventional Gas Unconventionally,*" CBM Gas Technology, New Technology Magazine, Oct./Nov. 2003, Title Page and pp. 1-4 (5 pages).
Gardes, Robert, "*A New Direction in Coalbed Methane and Shale Gas Recovery,*" (to the best of the Applicants' recollection, first received at The Canadian Institute Coalbed Methane Symposium conference on Jun. 16 and Jun. 17, 2002), 7 pages.
Gardes, Robert, "*Under-Balance Multi-Lateral Drilling for Unconventional Gas Recovery,*" (to the best of Applicants' recollection, first received at The Unconventional Gas Revolution conference on Dec. 9, 2003, 38 pages.
Boyce, Richard G., "*High Resolution Selsmic Imaging Programs for Coalbed Methane Development,*" (to the best of the Applicants' recollection, first received at The Unconventional Gas Revolution conference on Dec. 10, 2003), 29 pages.
Mazzella, Mark, et al., "*Well Control Operations on a Multiwell Platform Blowout,*" WorldOil.com—Onlne Magazine Article, vol. 22, Part 1—pp. 1-7, Jan. 2001, and Part II, Feb. 2001, pp. 1-13 (20 pages).
Vector Magnetics, LLC, Case History, California, May 1999, "*Successful Kill of a Surface Blowout,*" 1999, pp. 1-12.
Cudd Pressure Control, Inc, "*Successful Well Control Operations—A Case Study: Surface and Subsurface Well Intervention on a Multi-Well Offshore Platform Blowout and Fire,*" 2000, pp. 1-17, http://www.cuddwellcontrol.com/literature/successful/successful_well.htm.
Purl, R., et al., "*Damage to Coal Permeability During Hydraulic Fracturing,*" SPE 21813, 1991, Title Page and pp. 109-115 (8 pages).
U.S. Dept. of Energy—Office of Fossil Energy, "*Multi-Seam Well Completion Technology: Implications for Powder River Basin Coalbed Methane Production,*" Sep. 2003, pp. 1-100, A-1 through A-10 (123 pages).
U.S. Dept. of Energy—Office of Fossil Energy, "*Powder River Basin Coalbed Methane Development and Produced Water Management Study,*" Nov. 2002, pp. 1-111, A-1 through A-14 (213 pages).
Fletcher, Sam, "*Anadarko Cuts Route Under Canadian River Gorge,*" Oil & Gas Journal, Jan. 5, 2004, pp. 28-30, (3 pages).

Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores,*" Moscow, Nedra Publishers, 1997, 15 pages.
Kalinin, et al., Translation of Selected Pages from Ch. 4, Sections 4.2 (p. 135), 10.1 (p. 402), 10.4 (pp. 418-419), "*Drilling Inclined and Horizontal Well Bores,*" Moscow, Nedra Publishers, 1997, 4 pages.
Arens, V. Zh., Translation of Selected Pages, "*Well-Drilling Recovery of Minerals,*" Moscow, Nedra Publishers, 1986, 7 pages.
Jet Lavanway Exploration, "*Well Survey,*" Key Energy Surveys, Nov. 2, 1997, 3 pages.
Precision Drilling, "*We Have Roots in Coal Bed Methane Drilling,*" Technology Services Group, Published on or before Aug. 5, 2002, 1 page.
U.S. Dept. of Energy, "*New Breed of CBM/CMM Recovery Technology,*" Jul. 2003, 1 page.
Ghiselin, Dick, "*Unconventional Vision Frees Gas Reserves,*" Natural Gas Quarterly, Sep. 2003, 2 pages.
CBM Review, World Coal, "*US Drilling into Asia,*" Jun. 2003, 4 pages.
Skrebowski, Chris, "*US Interest in North Korean Reserves,*" Petroleum, Energy Institute, Jul. 2003, 4 pages.
Zupanick , U.S. Patent Application entitled "Slant Entry Well System and Method," U.S. Appl. No. 10/004,316, Oct. 30, 2001 (WO 03/038233) (36 pages).
Zupanick, et al., U.S. Patent Application entitled "Method and System for Underground Treatment of Materials," U.S. Appl. No. 10/142,817, May 8, 2002 (WO 03/095795 A1) (55 pages).
Zupanick, et al, U.S. Patent Application entitled "Method and System for Controlling Pressure in a Dual Well System," U.S. Appl. No. 10/244,082, Sep. 12, 2002 (WO 2004/025072 A1) (30 pages).
Diamond et al., U.S. Patent Application entitled "Method and System for Removing Fluid From a Subterranean Zone Using an Enlarged Cavity," U.S. Appl. No. 10/264,535, Oct. 3, 2002 (37 pages).
Zupanick, U.S. Patent Application entitled "Method of Drilling Lateral Wellbores From a Slant Well Without Utilizing a Whipstock," U.S. Appl. No. 10/267,426, Oct. 8, 2002 (24 pages).
Rial et al., U.S. Patent Application entitled "Method and System for Contolling the Production Rate Of Fluid From A Subterranean Zone To Maintain Production Bore Stability In The Zone," U.S. Appl. No. 10/328,408, Dec. 23, 2002 (29 pages).
Zupanick, et al., U.S. Patent Application entitled "Method and System for Recirculating Fluid in a Well System," U.S. Appl. No. 10/457,103, Jun. 5, 2003 (41 pages).
Zupanick, U.S. Patent Application entitled "Method and System for Accessing Subterranean Deposits from the Surface and Tools Therefor," U.S. Appl. No. 10/630,345, Jul. 29, 2003 (366 pages).
Pauley, Steven, U.S. Patent Application entitled "Multi-Purpose Well Bores and Method for Accessing a Subterranean Zone From the Surface," U.S. Appl. No. 10/715,300, Nov. 17, 2003 (34 pages).
Seams, Douglas, U.S. Patent Application entitled "Method and System for Extraction of Resources from a Subterranean Well Bore," U.S. Appl. No. 10/723,322, Nov. 26, 2003 (40 pages).
Zupanick, U.S. Patent Application entitled "Slant Entry Well System and Method," U.S. Appl. No. 10/749,884, Dec. 31, 2003 (28 pages).
Zupanick, U.S. Patent Application entitled "Method and System for Accessing Subterranean Deposits from the Surface," U.S. Appl. No. 10/761,629, Jan. 20, 2004 (38 pages).
Zupanick, U.S. Patent Application entitled "Method and System for Testing A Partially Formed Hydrocarbon Well for Evaluation and Well Planning Refinement," U.S. Appl. No. 10/769,221, Jan. 30, 2004 (34 pages).
Platt, "Method and System for Lining Multilateral Wells," U.S. Appl. No. 10/722,841, Feb. 5, 2004 (30 pages).
Zupanick, "Three-Dimentsional Well System For Accessing Subterranean Zones," Feb. 11, 2004, U.S. Appl. No. 10/777,503 (27 pages).
Zupanick, "System And Method For Directional Drilling Utilizing Clutch Assembly," U.S. Appl. No. 10/811,118, Mar. 25, 2004 (35 pages).
Zupanick, "System and Method for Multiple Wells from a Common Surface Location," U.S. Appl. No. 10/788,694, Feb. 27, 2004 (26 pages).
Palmer, Ian D., et al., "*Coalbed Methane Well Completions and Stimulations,*" Chapter 14, Hydrocarbons From Coal, American Association of Petroleum Geologists, 1993, pp. 303-339.
Field, T.W., "*Surface to In-seam Drilling—The Australian Experience,*" Undated, 10 pages.
Drawings included in CBM well permit issued to CNX stamped Apr. 15, 2004 by the West Virginia Department of Environmental Protection (5 pages).
Website of Mitchell Drilling Contractors, "*Services: Dymaxion—Surface to In-seam,*" http://www.mitchell drilling.com/dymaxion.htm, printed as of Jun. 17, 2004, 4 pages.
Website of CH4, "About Natural Gas—Technology," http://www.ch4.com.au/ng_technology.html, copyright 2003, printed as of Jun. 17, 2004, 4 pages.
Thomson, et al., "*The Application of Medium Radius Directional Drilling for Coal Bed Methane Extraction,*" Lucas Technical Paper, copyrighted 2003, 11 pages.
U.S. Department of Energy, DE-FC26-01NT41148, "*Enhanced Coal Bed Methane Production and Sequestration of CO2 in Unmineable Coal Seams*" for Consol, Inc., accepted Oct. 1, 2001, 48 pages.
U.S. Department of Energy, "*Slant Hole Drilling,*" Mar. 1999, 1 page.
Desai, Praful, et al., "*Innovative Design Allows Construction of Level 3 or Level 4 Junction Using the Same Platform,*" SPE/Petroleum Society of CIM/CHOA 78965, Canadian Heavy Oil Association, 2002, pp. 1-11.
Bybee, Karen, "*Advanced Openhole Multilaterals,*" Horizontal Wells, Nov. 2002, pp. 41-42.
Bybee, Karen, "*A New Generation Multilateral System for the Troll Olje Field,*" Multilateral/Extended Reach, Jul. 2002, 2 pages.
Emerson,, A.B., et al., "*Moving Toward Simpler, Highly Functional Multilateral Completions,*" Technical Note, Journal of Canadian Petroleum Technology, May 2002, vol. 41, No. 5, pp. 9-12.
Moritis, Guntis, "*Complex Well Geometries Boost Orinoco Heavy Oil Producing Rates,*" XP-000969491, Oil & Gas Journal, Feb. 28, 2000, pp. 42-46.
Themig, Dan, "*Multilateral Thinking,*" New Technology Magazine, Dec. 1999, pp. 24-25.
Smith, R.C., et al., "*The Lateral Tie-Back System: The Ability to Drill and Case Multiple Laterals,*" IADC/SPE 27436, Society of Petroleum Engineers, 1994, pp. 55-64, plus Multilateral Services Profile (1 page) and Multilateral Services Specifications (1 page).
Notification of Transmittal of the International Search Report or the Declaration (PCT Rule 44.1) (3 pages) and International Search Report (4 pages) re International Application No. PCT/US 03/13954 mailed Sep. 1, 2003.
Logan, Terry L., "*Drilling Techniques for Coalbed Methane,*" Hydrocarbons From Coal, Chapter 12, Copyright 1993, Title Page, Copyright Page, pp. 269-285.
Hanes, John, "*Outbursts on Leichhardt Colliery: Lessons Learned,*" International Symposium-Cum-Workshop on Management and Control of High Gas Emissions and Outbursts in Underground Coal Mines, Wollongong, NSW, Australia, Mar. 20-24, 1995, Title page, pp. 445-449.
Williams, Ray, et al., "*Gas Reservoir Properties for Mine Gas Emission Assessment,*" Bowen Basin Symposium 2000, pp. 325-333.
Brown, K., et al., "*New South Wales Coal Seam Methane Potential,*" Petroleum Bulletin 2, Department of Mineral Resources, Discovery 2000, Mar. 1996, pp. i-viii, 1-96.
Fipke, S., et al., "*Economical Multilateral Well Technology for Canadian Heavy Oil,*" Petroleum Society, Candadian Institute of Mining, Metallurgy & Petroleum, Paper 2002-100, to be presented in Calgary Alberta, Jun. 11-13, 2002, pp. 1-11.
PowerPoint Presentation entitled, "Horizontal Coalbed Methane Wells," by Bob Stayton, Computalog Drilling Services, date is believed to have been in 2002 (39 pages).
Denney, Dennis, "*Drilling Maximum-Reservoir-Contact Wells in the Shaybah Field,*" SPE 85307, pp. 60, 62-63, Oct. 20, 2003.

Lukas, Andrew, Lucas Drilling Pty Ltd., "Technical Innovation and Engineering Xstrata—Oaky Creek Coal Pty Limited," Presentation at Coal Seam Gas & Mine Methane Conference in Brisbane, Nov. 22-23, 2004 (51 pages).

Field, Tony, Mitchell Drilling, "Let's Get Technical—Drilling Breakthroughs in Surface to In-Seam in Australia," Presentation at Coal Seam Gas & Mine Methane Conference in Brisbane, Nov. 22-23, 2004 (20 pages).

Zupanick, Joseph A, "Coal Mine Methane Drainage Utilizing Multilateral Horizontal Wells," 2005 SME Annual Meeting & Exhibit, Feb. 28-Mar. 2, 2005, Salt Lake City, Utah (6 pages).

The Official Newsletter of the Cooperative Research Centre for Mining Technology and Equipment, CMTE News 7, "Tight-Radius Drilling Clinches Award," Jun. 2001, 1 page.

Listing of 174 References received from Third Party on Feb. 16, 2005 (9 pages).

Gardes Directional Drilling, "Multiple Directional Wells From Single Borehole Developed," Reprinted from Jul. 1989 edition of Offshore, Copyright 1989 by PennWell Publishing Company (4 pages).

"Economic Justification and Modeling of Multilateral Wells," Economic Analysis, Hart'S Petroleum Engineer International, 1997 (4 pages).

Mike Chambers, "Multi-Lateral Completions at Mobil Past, Present, and Future," presented at the 1998 Summit on E&P Drilling Technologies, Strategic Research Institute, Aug. 18-19, 1998 in San Antonio, Texas (26 pages).

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982 (56 pages).

P. Corlay, D. Bossie-Codreanu, J.C. Sabathier and E.R. Delamaide, "Improving Reservoir Management With Complex Well Architectures," Field Production & Reservoir Management, World Oil, Jan. 1997 (5 pages).

Eric R. Skonberg and Hugh W. O'Donnell, "Horizontal Drilling for Underground Coal Gasification," presented at the Eighth Underground Coal Conversion Symposium, Keystone, Colorado, Aug. 16, 1982 (8 pages).

Gamal Ismail, A.S. Fada'q, S. Kikuchi, H. El Khatib, "Ten Years Experience in Horizontal Application & Pushing the Limits of Well Construction Approach in Upper Zakum Field (Offshore Abu Dhabi)," SPE 87284, Society of Petroleum Engineers, Oct. 2000 (17 pages).

Gamal Ismail, H. El-Khatib—ZADCO, Abu Dhabi, UAE, "Multi-Lateral Horizontal Drilling Problems & Solutions Experienced Offshore Abu Dhabi," SPE 36252, Society of Petroleum Engineers, Oct. 1996 (12 pages).

C.M. Matthews and L.J. Dunn, "Drilling and Production Practices to Mitigate Sucker Rod/Tubing Wear-Related Failures in Directional Wells," SPE 22852, Society of Petroleum Engineers, Oct. 1991 (12 pages).

H.H. Fields, Stephen Krickovic, Albert Sainato, and M.G. Zabetakis, "Degasification of Virgin Pittsburgh Coalbed Through a Large Borehole," RI-7800, Bureau of Mines Report of Investigations/1973, United States Department of the Interior, 1973 (31 pages).

William P. Diamond, "Methane Control for Underground Coal Mines," IC-9395, Bureau of Mines Information Circular, United States Department of the Interior, 1994 (51 pages).

Technology Scene Drilling & Intervention Services, "Weatherford Moves Into Advanced Multilateral Well Completion Technology," *Reservoir Mechanics,* Weatherford International, Inc., 2000 Annual Report (2 pages).

"A Different Direction for CBM Wells," *W Magazine,* 2004 Third Quarter (5 pages).

Snyder, Robert E., "What's New in Production," *WorldOil Magazine,* Feb. 2005, [retrieved from the internet on Mar. 7, 2005], http://www.worldoil.com/magazine/MAGAZINE_DETAIL.asp?ART_ID=2507@MONTH_YEAR (3 pages).

Nazzal, Greg, "Moving Multilateral Systems to the Next Level," Strategic Acquisition Expands Weatherford's Capabilities, 2000 (2 pages).

Bahr, Angie, "Methane Draining Technology Boosts Safety and Energy Production," Energy Review, Feb. 4, 2005, Website: www.energyreview.net/storyviewprint.asp, printed Feb. 7, 2005 (2 pages).

Molvar, Erik M., "Drilling Smarter: Using Directional Drilling to Reduce Oil and Gas Impacts in the Intermountain West," Prepared by Biodiversity Conservation Alliance, Report issued Feb. 18, 2003, 34 pages.

King, Robert F., "Drilling Sideways—A Review of Horizontal Well Technology and Its Domestic Application," DOE/EIA-TR-0565, U.S. Department of Energy, Apr. 1993, 30 pages.

Dreiling, Tim, McClelland, M.L. and Bilyeu, Brad, "Horizontal & High Angle Air Drilling in the San Juan Basin, New Mexico," Believed to be dated Apr. 1996, pp. 1-11.

Technology Scene Drilling & Intervention Services, "Weatherford Moves Into Advanced Multilateral Well Completion Technology," and "Productivity Gains and Safety Record Speed Acceptance of UBS," *Reservoir Mechanics,* Weatherford International, Inc., 2000 Annual Report (2 pages).

Santos, Helio, SPE, Impact Engineering Solutions and Jesus Olaya, Ecopetrol/ICP, "*No-Damage Drilling: How to Achieve this Challenging Goal*?," SPE 77189, Copyright 2002, presented at the IADC/SPE Asia Pacific Drilling Technology, Jakarta, Indonesia, Sep. 9-11, 2002, 10 pages.

Santos, Helio, SPE, Impact Engineering Solutions, "*Increasing Leakoff Pressure with New Class of Drilling Fluid,*" SPE 78243, Copyright 2002, presented at the SPE/ISRM Rock Mechanics Conference in Irving, Texas, Oct. 20-23, 2002, 7 pages.

Franck Labenski, Paul Reid, SPE, and Helio Santos, SPE, Impact Solutions Group, "*Drilling Fluids Approaches for Control of Wellbore Instability in Fractured Formations,*" SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.

P. Reid, SPE, and H. Santos, SPE, Impact Solutions Group, "*Novel Drilling, Completion and Workover Fluids for Depleted Zones: Avoiding Losses, Formation Damage and Stuck Pipe,*" SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.

Craig C. White and Adrian P. Chesters, NAM; Catalin D. Ivan, Sven Maikranz and Rob Nouris, M-I L.L.C., "*Aphron-based drilling fluid: Novel technology for drilling depleted formations,*" World Oil, Drilling Report Special Focus, Oct. 2003, 6 pages.

U.S. Environmental Protection Agency, "Directional Drilling Technology," prepared for the EPA by Advanced Resources International under Contract 68-W-00-094, Coalbed Methane Outreach Program (CMOP), Website: http://search.epa.gov/s97is.vts, printed Mar. 17, 2005, 13 pages.

Notes on Consol Presentation (by P. Thakur) made at OGA PA in Pittsburgh, Pennsylvania on May 22, 2002 (3 pages).

Robert E. Snyder, "Drilling Advances," World Oil, Oct. 2003, 1 page.

"Meridian Tests New Technology," Western Oil World, Jun. 1990, Cover, Table of Contents and p. 13.

Clint Leazer and Michael R. Marquez, "Short-Radius Drilling Expands Horizontal Well Applications," Petroleum Engineer International, Apr. 1995, 6 pages.

Terry R. Logan, "Horizontal Drainhole Drilling Techniques Used in Rocky Mountains Coal Seams," Geology and Coal-Bed Methane Resources of the Northern San Juan Basin, Colorado and New Mexico, Rocky Mountain Association of Geologists, Coal-Bed Methane, San Juan Basin, 1988, pp. cover, 133-142.

Daniel J. Brunner, Jeffrey J. Schwoebel, and Scott Thomson, "Directional Drilling for Methane Drainage & Exploration in Advance of Mining," Website: http://www.advminingtech.com.au/Paper4.htm, printed Apr. 6, 2005, Copyright 1999, Last modified Aug. 7, 2002 (8 pages).

Karen Bybee, highlights of paper SPE 84424, "Coalbed-Methane Reservoir Simulation: An Evolving Science," by T.L. Hower, JPT Online, Apr. 2004, Website: http://www.spe.org/spe/jpt/jsp/ jptpapersynopsis/0,2439,1104_11038_2354946_2395832.00.html, printed Apr. 14, 2005, 4 pages.
Kevin Meaney and Lincoln Paterson, "Relative Permeability in Coal," SPE 36986, Society of Petroleum Engineers, Copyright 1996, pp. 231-236.
Calender of Events—Conference Agenda, Fifth Annual Unconventional Gas and Coalbed Methane Conference, Oct. 22-24, 2003, in Calgary, Alberta, Website: http://www.csug.ca/cal/calc0301a.html, printed Mar. 17, 2005, 5 pages.
Tom Engler and Kent Perry, "Creating a Roadmap for Unconventional Gas R&D," Gas TIPS, Fall 2002, pp. 16-20.
CSIRO Petroleum—SIMEDWin, "Summary of SIMEDWin Capabilities," Copyright 1997-2005, Website: http://www.dpr.csiro.au/ourcapabilities/petroleumgeoengineering/reservoirengineering/projects/simedwin/assets/simed/index.html, printed Mar. 17, 2005, 10 pages.
Solutions From the Field, "Coalbed Methane Resources in the Southeast," Copyright 2004, Website: http://www.pttc.org/solutions/sol_2004/537.htm, printed Mar. 17, 2005, 7 pages.
Jeffrey R. Levine, Ph.D., "Matrix Shrinkage Coefficient," Undated, 3 pages.
G. Twombly, S.H. Stepanek, T.A. Moore, Coalbed Methane Potential in the Waikato Coalfield of New Zealand: A Comparison With Developed Basins in the United States, 2004 New Zealand Petroleum Conference Proceedings, Mar. 7-10, 2004, pp. 1-6.
R. W. Cade, "Horizontal Wells: Development and Applications," Presented at the Fifth International Symposium on Geophysics for Mineral, Geotechnical and Environmental Applications, Oct. 24-28, 1993 in Tulsa, Oklahoma, Website: http://www.mgls.org/93Sym/Cade/cade.html, printed Mar. 17, 2005, 6 pages.
Solutions From the Field, "Horizontal Drilling, A Technology Update for the Appalachian Basin," Copyright 2004, Website: http://www.pttc.org/solutions/sol_2004/535.htm, printed Mar. 17, 2005, 6 pages.
R. Purl, J.C. Evanoff and M.L. Brugler, "Measurement of Coal Cleat Porosity and Relative Permeability Characteristics," SPE 21491, Society of Petroleum Engineers, Copyright 1991, pp. 93-104.
Peter Jackson, "Drilling Technologies for Underground Coal Gasification," IMC Geophysics Ltd., International UCG Workshop—Oct. 2003 (20 pages).
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/002162 mailed Apr. 22, 2005.
Notification of Transmittal of the International Search Report and the Written Opinion of the International Searching Authority, or the Declaration (3 pages), International Search Report (3 pages) and Written Opinion of the International Searching Authority (5 pages) re International Application No. PCT/US2005/005289 mailed Apr. 29, 2005.
Notification of Transmittal of the International Search Report and the Written Opinion of the International Searching Authority, or the Declaration (3 pages), International Search Report (5 pages) and Written Opinion of the International Searching Authority (5 pages) re International Application No. PCT/US2004/036616 mailed Feb. 24, 2005.
Notification of Transmittal of International Preliminary Examination Report (1 page) and International Preliminary Examination Report (3 pages) for International Application No. PCT/US03/13954 mailed Apr. 14, 2005.
Notification of Transmittal of International Preliminary Examination Report (1 page) and International Preliminary Examination Report (5 pages) mailed Jan. 18, 2005 and Written Opinion (8 pages) mailed Aug. 25, 2005 for International Application No. PCT/US03/30126.
Notification of Transmittal of the International Search Report or the Declaration (3 pages) and International Search Report (5 pages) mailed Nov. 10, 2000 for International Application No. PCT/US99/27494.
Notification of Transmittal of International Preliminary Examination Report (1 page) and International Preliminary Examination Report (6 pages) mailed Apr. 2, 2001 and Written Opinion mailed Sep. 27, 2000 for International Application No. PCT/US99/27494.
Notification of Transmittal of the International Search Report or the Declaration (3 pages) and International Search Report (5 pages) mailed Jun. 6, 2002 for International Application No. PCT/US02/02051.
Notification of Transmittal of the International Search Report or the Declaration (3 pages) and International Search Report (6 pages) mailed Mar. 13, 2003 for International Application No. PC/US02/33128.
Notification of Transmittal of International Preliminary Examination Report (1 page) and International Preliminary Examination Report (3 pages mailed Apr. 22, 2004 and Written Opinion mailed Sep. 4, 2003 for International Application No. PCT/US02/33128.
Notification of Transmittal of the International Search Report and the Written Opinion of the International Searching Authority, or the Declaration (3 pages), International Search Report (5 pages) and Written Opinion of the International Searching Authority (6 pages) re International Application No. PCT/US2004/012029 mailed Sep. 22, 2004.
Brunner, D.J. and Schwoebel, J.J., "Directional Drilling for Methane Drainage and Exploration in Advance of Mining," REI Drilling Directional Underground, World Coal, 1999, 10 pages.
Thakur, P.C., "A History of Coalbed Methane Drainage From United States Coal Mines," 2003 SME Annual Meeting, Feb. 24-26, Cincinnati, Ohio, 4 pages.
U.S. Climate Change Technology Program, "Technology Options for the Near and Long Term," 4.1.5 Advances in Coal Mine Methane Recovery Systems, pp. 162-164.
Notification of Transmittal of the International Search Report and the Written Opinion of the International Searching Authority, or the Declaration (3 pages), International Search Report (3 pages) and Written Opinion of the International Searching Authority (7 pages) re International Application No. PCT/US2004/017048 mailed Oct. 21, 2004.
Gardes, Robert, "Multi-Seam Completion Technology," Natural Gas Quarterly, E&P, Jun. 2004, pp. 78-81.
Baiton, Nicholas, "Maximize Oil Production and Recovery," Vertizontal Brochure, received Oct. 2, 2002, 4 pages.
Dreiling, Tim, McClelland, M.L. and Bilyeu, Brad, "Horizontal & High Angle Air Drilling in the San Juan Basin, New Mexico," Dated on or about Mar. 6, 2003, pp. 1-11.
Fong, David K., Wong, Frank Y., and McIntyre, Frank J., "An Unexpected Benefit of Horizontal Wells on Offset Vertical Well Productivity in Vertical Miscible Floods," Canadian SPE/CIM/CANMET Paper No. HWC94-09, paper to be presented Mar. 20-23, 1994, Calgary, Canada, 10 pages.
Fischer, Perry A., "What's Happening in Production," World Oil, Jun. 2001, p. 27.
Website of PTTC Network News vol. 7, 1st Quarter 2001, Table of Contents, http://www.pttc.org/../news/v7n1nn4.htm printed Apr. 25, 2003, 3 pages.
Cox, Richard J.W., "Testing Horizontal Wells While Drilling Underbalanced," Delft University of Technology, Aug. 1998, 68 pages.
McLennan, John, et al., "Underbalanced Drilling Manual," Gas Research Institute, Chicago, Illinois, GRI Reference No. GRI-97/0236, copyright 1997, 502 pages.
The Need for a Viable Multi-Seam Completion Technology for the Powder River Basin, Current Practice and Limitations, Gardes Energy Services, Inc., Believed to be 2003 (8 pages).
Langley, Diane, "Potential Impact of Microholes Is Far From Diminutive," JPT Online, http://www.spe.org/spe/jpt/jps, Nov. 2004 (5 pages).
Consol Energy Slides, "Generating Solutions, Fueling Change," Presented at Appalachian E&P Forum, Harris Nesbitt Corp., Boston, Oct. 14, 2004 (29 pages).
Notification of Transmittal of the International Search Report and the Written Opinion of the International Searching Authority, or the Declaration (3 pages), International Search Report (3 pages), and Written Opinion of the International Searching Authority (5 pages) re International Application No. PCT/US2004/024518 mailed Nov. 10, 2004.

Schenk, Christopher J., "Geologic Definition and Resource Assessment of Continuous (Unconventional) Gas Accumulations—the U.S. Experience," Website, http://aapg.confex.com/ . . . //, printed Nov. 16, 2004 (1 page).

U.S. Department of Interior, U.S. Geological Survey, "Characteristics of Discrete and Basin-Centered Parts of the Lower Silurian Regional Oil and Gas Accumulation, Appalachian Basin: Preliminary Results From a Data Set of 25 oil and Gas Fields," U.S. Geological Survey Open-File Report 98-216, Website, http://pubs.usgs.gov/of/1998/of98-216/introl.htm, printed Nov. 16, 2004 (2 pages).

Zupanick, J., "Coalbed Methane Extraction," 28th Minearl Law Conference, Lexington, Kentucky, Oct. 16-17, 2003 (48 pages).

Zupanick, J., "CDX Gas—Pinnacle Project," Presentation at the 2002 Fall Meeting of North American Coal Bed Methane Forum, Morgantown, West Virginia, Oct. 30, 2002 (23 pages).

Notification of Transmittal of the International Preliminary Report of Patentability (1 page) and International Preliminary Report on Patentability (12 pages) mailed Jan. 9, 2006 for International Application No. PCT/US2004/036616.

Notification Concerning Transmittal of Copy of International Preliminary Report on Patentability (Chapter 1 of the Patent Cooperation Treaty) (1 page), International Preliminary Report on Patentability (1 page), and Written Opinion of the International Searching Authority (7 pages) mailed Dec. 22, 2005 for International Application No. PCT/US2004/017048.

European Search and Examination Report, completed Dec. 5, 2005 for Application No. EP 02020737, 5 pages.

P.C. Thakur and W.N. Poundstone, "Horizontal Drilling Technology for Advance Degasification," Society of Mining Engineers of AIME, Preprint Number 79-113, For presentation at the 1979 AIME Annual Meeting, New Orleans, Lousiana, Feb. 18-22, 1979, Engineering Societies Library stamp dated Feb. 5, 1980, 11 pages.

Notification Concerning Transmittal of Copy of International Preliminary Report on Patentability (1 page), International Preliminary Report on Patentability (1 page), and Written Opinion of the International Searching Authority (5 pages) mailed Feb. 9, 2006 for International Application No. PCT/US2004/024518.

Wang Weiping, "*Trend of Drilling Technology Abroad*," Petroleum Drilling and Production Technology, 1995 (vol. 17), Issue 6, www.cnki.net, 8 pages, translation, original in Chinese.

Tver, David, *The Petroleum Dictionary*, 1980, p. 221.

Rennick, et al., " *Demonstration of Safety Plugging of Oil Wells Penetrating Appalachian Coal Mines*," Bureau of Mines Coal Mine Health and Safety Research Program, Technical Progress Report—56, U.S. Department of the Interior, Jul. 1972, 25 pages.

George N. Aul and Joseph Cervik, " *Grouting Horizontal Drainage Holes in Coalbeds*," RI 8375, Bureau of Mines Report of Investigations, U.S. Department of the Interior, 1979, 21 pages.

Paul J. Componation, et al.," *Cleaning Out, Sealing and Mining Through Wells Penetrating Areas of Active Coal Mines in Northern West Virginia*," MESA Information Report 1052, U.S. Department of the Interior, 1977, 26 pages.

George S. Rice," *Notes on the Prevention of Dust and Gas Explosions in coal Mines*," Technical Paper 56, Bureau of Mines, Department of the Interior, copyright 1913, 12 pages.

George S. Rice, et al., " *Oil and Gas Wells Through Workable Coal Beds*," Bulletin 65, Petroleum Technology 7, Bureau of Mines, Department of Interior, copyright 1913, 54 pages.

Notification of Transmittal of the International Preliminary Report on Patentability (1 page) and International Preliminary Report on Patentability (8 pages) for International Application No. PCT/US2005/002162 mailed May 3, 2006.

D. Nathan Meehan," *Technology Vital For Horizontal Well Success*," Oil & Gas Journal, Dec. 11, 1995, 8 pages.

B.A. Tarr, A.F. Kuckes and M.V. Ac, " *Use of New Ranging Tool to Position a Vertical Well Adjacent to a Horizontal Well*," SPE Drilling Engineering, Jun. 1992, 7 pages.

William J. McDonald, Ph.D., John H. Cohen, and C. Mel Hightower, " *New Lightweight Fluids for Underbalanced Drilling*," believed to be on or about 1998, 10 pages.

Philip C. Crouse," *Application and Needs for Advanced Multilateral Technologies and Strategies*," Website: www.netl.doe.gov/publications/proceedings/97/97ng/ng97_pdf/NG-5.pdf; Believed to be on or about 1997, 9 pages.

Dan Theming, " *Multi-Laterals Providing New Options*," The American Oil & Gas Reporter, V. 39, No. 7 Jul. 1996, 4 pages.

Daniel D. Gleltman," *Integrated Underbalanced Directional Drilling System*," Interim Report for Period of Performance Oct. 1, 1995-Feb. 14, 1996, DOE FETC Contract DE-AC21-95MC31103, Mar. 1997, 23 pages.

J.D. Gallivan, N.R. Hewitt, M. Olsen, J.M. Peden, D. Tehrani and A.A.P. Tweedie, " *Quantifying the Benefits of Multi-Lateral Producing Wells*," SPE 30441, Society of Petroleum Engineers, Inc., Copyright 1995, 7 pages.

C.A. Ehlig-Economides, G.R. Mowat and C. Corbett, " *Techniques for Multibranch Well Trajectory Design in the Context of a Three-Dimensional Reservoir Model*," SPE 35505, Society of Petroleum Engineers, Copyright 1996, 8 pages.

Stephen R. Dittoe, Albertus Retnanto, and Michael J. Economides," *An Analysis of Reserves Enhancement in Petroleum Reservoirs with Horizontal and Multi-Lateral Wells*," SPE 37037, Society of Petroleum Engineers, Copyright 1996, 9 pages.

D.L. Boreck and M. T. Strever, " *Conservation of Methane from Colorado's Mined/Minable Coal Beds: A Feasibility Study*," Open-File Report 80.5, Colorado Geological Survey, Department of Natural Resources, Denver, Colorado, Oct. 1980, 101 pages.

B.G. kta and T. Ertekin, " *Implementation of a Local Grid Refinement Technique in Modeling Slanted, Undulating Horizontal and Multi-Lateral Wells*," SPE 56624, Society of Petroleum Engineers, Copyright 1999, 10 pages.

W.H. Leach Jr., " *New Technology for CBM Production*," Oil and Gas Investor, Opportunities in Coalbed Methane, Dec. 2002, 6 pages.

David Wagman,"*CBM Investors Keep Their Guard Up,*" Oil and Gas Investor, Opportunities in Coalbed Methan, Dec. 2002, 5 pages.

Stephen D. Schwochow, " *CBM: Coming to a Basin Near You,*" Oil and Gas Investor, Opportunities in Coalbed Methan, Dec. 2002, 7 pages.

" *White Paper: Guidebook on Coalbed Methane Drainage for Underground Coal Mines,*" paper prepared under U.S. Environmental Protection Agency Cooperative Agreement No. CX824467-01-0 with The Pennsylvania State University by Jan. M. Mutmansky, Apr. 1999, 50 pages.

M.G. Zabetakis, Maurice Deul, and M.L. Skow," *Methane Control in United States Coal Mines— 1972,*" Information Circular 8600, United States Department of the Interior, Bureau of Mines Information Circular/1973, 26 pages.

B. Goktas, " *A Comparative Analysis of the Production Characterlistics of Cavity Completions and Hydraulic Fractures in Coalbed Methane Reservoirs,*" Society of Petroleum Engineers, SPE 55600, Copyright 1999, 10 pages.

William P. Diamond and David C. Oyler, " *Drilling Long Horizontal Coalbed Methane Drainage Holes from a Directional Surface Borehole,*" Society of Petroleum Engineers, SPE/DOE 8968, 1980, 6 pages.

Turgay Ertekin, Wonmo Sung, and Fred C. Schwerer," *Production Performance Analysis of Horizontal Drainage Wells for the Degasification of Coal Seams,*" Journal of P etroleum Technology, May 1988, 8 pages.

Patrick B. Tracy, " *Lateral Drilling Technology Tested on UCG Project,*" IADC/SPE 17237, IADC/SPE Drilling Conference, Copyright 1988, 10 pages.

P.S. Sarkar and J.M. Rajtar, "*Transient Well Testing of Coalbed Methane Reservoirs With Horizontal Wells,*" SPE27681, Society of Petroleum Engineers, Copyright 1994, 9 pages.

R.A. Schraufnagel, D.G. Hill and R.A. McBane, " *Coalbed Methane— A Decade of Success*," SPE 28581, Society of Petroleum Engineers, Copyright 1994, 14 pages.

J.R. Kelafant, C.M. Boyer, and M.D. Zuber, " *Production Potential and Strategies for Coalbed Methane in the Central Appalachian Basin*," SPE 18550, Society of Petroleum Engineers, Copyright 1988, 8 pages.

Ian Palmer, John McLennan, and Mike Kutas, " *Completions and Stimulations for Coalbed Methane Wells*," SPE 30012, Society of Petroleum Engineers, Copyright 1995, 13 pages.
John E. Jochen and Bradley M. Robinson, " *Survey of Horizontal Gas Well Activity*," SPE 35639, Society of Petroleum Engineers, Copyright 1996, 5 pages.
R.G. Jeffrey, J.R. Enever, J.H. Wood, J.P. Connors, S.K. Choi, K.T.A. Meaney, D.A. Casey and R.A. Koenig," *A Stimulation and Production Experiment in a Vertical Coal Seam Gas Drainage Well*," SPE 36982, Society of Petroleum Engineers, Copyright 1996, 7 pages.
Matt C. Rowan and Michael J. Whims," *Multilateral Well Enhances Gas Storage Deliverability*," Oil & Gas Journal, Dec. 25, 1995, 4 pages.
Dan Themig, " *Planning and Evaluation are Crucial to Multilateral Wells*," Petroleum Engineer International, Jan. 1996, 3 pages.
Larry Comeau, Randy Pustanyk, Ray Smith and Ian Gilles, " *Lateral Tie-Back System Increases Reservoir Exposure*," World Oil, Jul. 1995, 5 pages.
J. Smith, M.J. Economides and T.P. Frick, " *Reducing Economic Risk in Areally Anisotropic Formations With Multiple-Lateral Horizontal Wells,*" SPE 30647, Society of Petroleum Engineers, Copyright 1995, 14 pages.
Scott Thomson, Andrew Lukas, and Duncan McDonald, " *Maximising Coal Seam methane Extraction through Advanced Drilling Technology,*" Lucas, Technical Paper, second Annual Australian Coal Seam & Mine Methane Conference, Feb. 19-20, 2003, 14 pages.
William P. Diamond and David C. Oyler," *Directional Drilling for Coalbed Degasification in Advance of Mining,*" Proceedings of the 2nd Annual Methane Recovery from Coalbeds Symposium, Apr. 18-20, 1979, 17 pages.
John L. Stalder, Gregory D. York, Robert J. Kopper, Carl M. Curtis and Tony L. Cole, and Jeffrey H. Copley, " *Multilateral-Horizontal Wells Increase Rate and Lower Cost Per Barrel in the Zuata Field, Faja, Venezuela,*" SPE 69700, Society of Petroleum Engineers, Copyright 2001, 9 pages.
Brent Lowson, " *Multilateral-Well Planning,*" Synopis of SPE 39245, JPT, Jul. 1998, 4 pages.
A. Njaerheim, R. Rovde, E. Kvale, S.A. Kvamme, and H.M. Bjoerneli, "*Multilateral Well in Low-Productivity Zones,*" Synopsis of SPE39356, JPT, Jul. 1998, 4 pages
S.W. Bokhari, A.J. Hatch, A. Kyei, and O.C. Werngren, " *Improved Recovery from Tight Gas Sands with Multilateral Drilling,*" Synopsis of SPE 38629, JPT, Jul. 1998, 4 pages.
S.K. Vij, S.L. Narasaiah, Anup Walia, and Gyan Singh, " *Adopting Multilateral Technology,*" Synopsis of SPE 39509, JPT, Jul. 1998, 3 pages.
William P. Diamond, David C. Oyler, and Herbert H. Fields, "*Directionalty Controlled Drilling to Horizontally Intercept Selected Strata, Upper Freeport Coalbed, Green County, PA,*" Bureau of Mines Report of Investigations/1977, RI 8231, 1977, 25 pages.
David C. Oyler, William P. Diamond, and Paul W. Jeran," *Directional Drilling for Coalbed Degasification,*" Program Goals and Progress in 1978, Bureau of Mines Report of Investigations/1979, RI 8380, 1979, 17 pages.
United States Department of the Interior, " *Methane Control Research: Summary of Results, 1964-80,*" Bureau of Mines Bulletin, Bulletin 687, 1988, 188 pages.
EPA, " *Identifying Opportunities for Methane Recovery at U.S. Coal Mines: Profiles of Selected Gassy Underground Coal Mines 1997-2001,*" EPA Publication EPA 430-K-04-003, Jul. 2004, 202 pages.
Marshall DeLuca,"*Multilateral Completions on the Verge of Mainstream,*" Offshore, Apr. 1997, 2 pages.
Bob Williams, " *Operators Unlocking North Slope's Viscous Oil Commerciality,*" Oil & Gas Journal, Augl. 6, 2001, 5 pages.
James P. Oberkircher,"*The Economic Viability of Multilateral Wells,*" IAD/SPE 59202, Society of Petroleum Engineers, Copyright 2000, 10 pages.
Jim Oberkircher, " *What is the Future of Multilateral Technology?*" World Oil, Jun. 2001, 3 pages.
Rick Von Flatern, " *Operators Are Ready For More Sophisticated Multilateral Well Technology,*" Petroleum Engineer International Jan. 1996, 4 pages.
Kyle S. Graves, " *Multiple Horizontal Drainholes Can Improve Production,*" Oil & Gas Journal, OGJ Special, Feb. 14, 1994, 5 pages.
Guntis, Moritis, *"Sincor Nears Upgrading, Plateau Production Phase,"* Oil & Gas Journal, Oct. 29, 2001, 1 page.
Guntis Moritis, *"Smart, Intelligent Wells,"* Oil & Gas Journal, Apr. 2, 2001, 6 pages.
Craig Coull, *"Intelligent Completion Provides Savings for Snorre' TLP,"* Oil & Gas Journal, Apr. 2, 2001, 2 pages.
D.T. Vo and M.V. Madden, " *Performance Evaluation of Trilateral Wells:Field Examples,*" SPE 28376, Society of Petroleum Engineers, copyright 1994, 16 pages.
Dean E. Gaddy, " *Pioneering Work, Economic Factors Provide Insights Into Russian Drilling Technology,*" Oil & Gas Journal, Jul. 6, 1998, 3 pages.
" *Optimal Multilateral-Well Design for a Heavy-Oil Reservoir,*" Synopsis of SPE 37554 by D.W. Boardman, JPT, Jul. 1997, 3 pages.
" *Multilateral-Well Completion-System Advances,*" Synopsis of SPE 39125 by J.R. Longbottom et al., JPT, Jul. 1997, 3 pages.
" *Optimal Multilateral/Multibranch Completions,*" Synopsis of SPE 38033 by Hironori Sugiyama et al., JPT, Jul. 1997, 5 pages.
" *Multilateral Experiences:IDD El Shargi North Dome Field (QATAR),*" Synopsis of SPE 37675by J.R. Scofield et al., JPT, Jul. 1997, 3 pages.
" *Moving Toward the 'Intelligent Well',*" Synopsis of SPE 39126 by Clark E. Robison, JPT, Jul. 1997, 3 pages.
"*Short-Radius Laterals: An Operator's Experience,*" Synopsis of SPE 37493 by C. Ellis et al., JPT, Jul. 1997, 3 pages.
"*Analyzing a Multilateral-Well Failure,*" Synopsis of SPE 38268 by A. Ray Brister, JPT, Jul. 1997, 3 pages.
"*A New Concept for Multibranch Technology,*" Synopsis of SPE 39123 by Mark Stracke et al., JPT, Jul. 1997, 3 pages.
"*Classification Clarifies Multilateral Options,*" Synopsis of SPE 38493 by C. Hogg, JPT, Jul. 1997, 3 pages.
"*Infill Development With Multilateral-Well Technology,*" Synopsis of SPE 38030 by Sau-Wai Wong et al., JPT, Jul. 1997, 3 pages.
Brad Califf and Denny Kerry, "*UPRC Completes First Quad-Lateral Well,*" Petroleum Engineer International, Sep. 1993, 4 pages.
Jack Winton, "*Use of Multi-lateral Wells to Access Marginal Reservoirs,*" Offshore, Feb. 1999, 3 pages.
J.R. Salas, P.J. Clifford and D.P. Jenkins, "*Brief: Multilateral Well Performance Prediciton,*" JPT, Sep. 1996, 3 pages.
Mike R. Chambers, "*Multilateral Technology Gains Broader Acceptance,*" Oil & Gas Journal, Nov. 23, 1998, 5 pages.
S. Ikeda, T. Takeuchi, and P.C. Crouse, "*An Investigative Study on Horizontal Well and Extended Reach Technologies With Reported Problem Areas and Operational Practice in North America and Europe,*" IADC/SPE 35054, Society of Petroleum Engineers, Copyright 1996, 8 pages.
Greg Nazzal, "*Extended-Reach Wells tap outlying Reserves,*" World Oil, Mar. 1993, 8 pages.
Bambang Tjondrodiputro, Harry Eddyarso and Kim Jones, "*How ARCO Drills High-Angle Wells Offshore Indonesia,*" World Oil, Mar. 1993, 11 pages.
S. Hovda, et al., "*World's First Application of a Multilateral System Combining a Cased and Cemented Junction With Fullbore Access to Both Laterals,*" SPE 36488, Society of Petroleum Engineers, Copyright 1996, 15 pages.
Robert A. Gardes, "*Micro-annulus Under-balanced Drilling of Multilateral Wells,*" Offshore May 1996, 4 pages.
Brent Lowson, "*Phillips Multilateral Features Several Firsts for North Sea,*" Offshore, Feb. 1997, 2 pages.
J.R. Scofield, B. Laney and P. Woodard, "*Field Experience With Multi-Laterals in the Idd El Shargi North Dame Field (Qatar),*" SPE/IADC 37675, Society of Petroleum Engineers, Copyright 1997, 11 pages.
Jeremy Beckman, "*Coiled Tubing, Reamer Shoes Push Through Barriers in North Sea Wells,*" Offshore, Feb. 1997, 1 pages.

C.H. Fleming, "*Comparing Performance of Horizontal Versus Vertical Wells,*" World Oil, Mar. 1993, 7 pages.
Larry A. Cress and Stephen W. Miller, "*Dual Horizontal Extension Drilled Using Retrievable Whipstock,*" World Oil Jun. 1993, 9 pages.
Guntis Moritis, "*Heavy Oil Expansions Gather Momentum Worldwide,*" Oil & Gas Journal, Aug. 14, 1995, 6 pages.
K.W. Hart and L.V. Jankowski, "*The Application of Slant Hole Drilling in Development of Shallow Heavy Oil Deposits,*" The Journal of Canadian Petroleum Technology, Jan.-Feb. 1984, Montreal, 6 pages.
Jeff Smith and Bob Edwards, "*Slant Rigs Offer Big Payoffs in Shallow Drilling,*" Oil & Gas Journal, Mar. 30, 1992, 3 pages.
Ravil Gabdullinovich Salikhov, Evgeny Fedyorovich Dubrovin, and Vladimir Vladimirovich Sledkov, "*Cluster and Dual-Lateral Drilling Technologies Optimize Russian Well Production,*" Oil & Gas Journal, Nov. 24, 1997, 7 pages.
Dean E. Gaddy, "*Inland Barge to Allow Cluster Drilling in Nigeria,*" Oil & Gas Journal, Aug. 30, 1999, 7 pages.
Cliff Hogg, "*Comparison of Multilateral Completion Scenarios and Their Application,*" SPE 38493, Society of Petroleum Engineers, Copyright 1997, 11 pages.
S.W. Bokhari, A.J. Hatch, A. Kyei and O.C. Wemgren, "*Improved Recoveries in the Pickerill Field from Multilateral Drilling into Tight Gas Sands,*" SPE 38629, Society of Petroleum Engineers, Copyright 1997, 15 pages.
J.R. Longbottom, Dana Dale, Kevin Waddell, Scott Bruha, and John Roberts, "*Development, Testing, and Field Case Histories of Multilateral Well Completion Systems,*" SPE 36994, Society of Petroleum Engineers, Copyright 1996, 16 pages.
E.J. Antczak, D.G.L. Smith, D.L. Roberts, Brent Lowson, and Robert Norris, "*Implementation of an Advanced Multi-Lateral System With Coiled Tubing Accessibility,*" SPE/IADC 37673, Society of Petroleum Engineers, Copyright 1997, 9 pages.
H. Azoba, O. Akinmoladun, H. Rothenhofer, D. Kent and N. Nawfal, "*World Record Dual- and Tri-lateral Wells,*" SPE/IADC 39240, Society of Petroleum Engineers, Copyright 1997, 6 pages.
R.W. Taylor and Rick Russell, "*Case Histories: Drilling and Completing Multilateral Horizontal Wells in the Middle East,*" SPE/IADC 39243, Society of Petroleum Engineers, copyright 1997, 14 pages.
D.K. Triolo and R.A. Mathes, "*Review of a Multi-Lateral Drilling and Stimulation Program,*" SPE/IADC 39242, copyright 1997, Society of Petroleum Engineers, 13 pages.
John H. Perry, Leonard J. Prosser, Jr., Joseph Cervik, "*Methane Drainage from the Mary Lee Coalbed, Alabama, Using Horizontal Drilling Techniques,*" SPE/DOE 8967, Society of Petroleum Engineers, May 18, 1980, 6 pages.
Gerald L. Finfinger, Leonard J. Prosser, and Joseph Cervik, "*Influence of Coalbed Characteristics and Geology onMethane Drainage,*" SPE/DOE 8964, Society of Petroleum Engineers, May 18, 1980, 6 pages.
Hilmer Von Schonfeldt, B. Rao Pothini, George N. Aul and Roger L. Henderson, "*Production and Utilization of Coalbed Methane Gas in Island Creek Coal Company Mines,*" SPE/DOE 10817, Society of Petroleum Engineers, May 16, 1982, 10 pages.
Joseph Cervik, H.H. Fields, and G.N. Aul, "*Rotary Drilling Holes in Coalbeds for Degasification,*" RI 8097, Bureau of Mines Reporting of Investigations, 1975, 26 pages.
D.G. Masszi and A.A. Kahil, "*Coal Demethanation Principles and Field Experience,*" The Journal of Canadian Petroleum Technology,Jul. -Aug. 1982, 4 pages.
Tobias W. Goodman, Joseph Cervik, and George N. Aul, "*Degasification Study From on Air Shaft in the Beckley Coalbed,*" RI 8675, Bureau of Mines Report of Investigations, 1982, 23 pages.
P.C. Thakur and H.D. Dahl, "*Horizontal Drilling—A Tool for Improved Productivity,*" Mining Engineering, Mar. 1982, 3 pages.
P.C. Thakur and J.G. Davis II, "*How to Plan for Methane Control in Underground Coal Mines,*" Mining Engineering, Oct. 1977, 5 pages.
A.B. Yost II and B.H. Javins, "*Overview of Appalachian Basin High-Angle and Horizontal Air and Mud Drilling,*" SPE 23445, Society of Petroleum Engineers, Oct. 22, 1991, 14 pages.
Pramod C. Thakur, "*Methane Flow in the Pittsburgh Coal Seam,*" Third International Mine Ventilation Congress, England, U.K., Jun. 13-19, 1984, 17 pages.
Chapter 10 by Pramod C. thakur, "*Methane Control for Longwall Gobs,*" Longwall -Shortwall Mining, State of the art by R.V. Ramani, published by New York: Society of Mining Engineers of the American Institute of Mining, Metallurgical, and Petroleum Engineers, 1981, 7 pages.
Pramod C. Thakur, Stephen D. Lauer, and Joseph Cervik, "*Methane Drainge With Cross-Measure Boreholes on a Retreat Longwall Face,*" Preprint No. 83-398, Society of Mining Engineers of AIME, for presentation at the SME-AIME Fall Meeting and Exhibit, Salt Lake City, Utah, Oct. 19-21, 1983, 14 pages.
Warren F. Dobson and Daniel R. Seelye, "*Mining Technology Assists Oil Recovery from Wyoming Field,*" SPE 9418, Society of Petroleum Engineers of AIME, Copyright 1980, 7 pages.
T.L. Logan, J.J. Schwoebel and D.M. Horner, "*Application of Horizontal Drainhole Drilling Technology for Coalbed Methane Recovery,*" SPE/DOE 16409, Society of Petroleum Engineers/U.S. Department of Energy, Copyright 1997, 12 pages.
Samuel O. Osisanya and Robert F. Schaffitzel, "*Review of Horizontal Drilling and Completion Techniques for Recovery of Coalbed Methane,*" SPE 37131, Society of Petroleum Engineers, Copyright 1996, 13 pages.
S.D. Joshi, "*A Review of Horizontal Well and Drainhole Technology,*" SPE 16868, Society of Petroleum Engineers, Copyright 1987, 17 pages.
R. Bitto, A.B. Henderson and L. Broussard, "*Recent Case Histories of New Well Applications for Horizontal Drilling,*" SPE 21262, Society of Petroleum Engineers, Copyright 1990, 12 pages.
M. R. Konopczynski, John Hughes and J.E. Best, "*A Novel Approach to Initiating Multi-Lateral Horizontal Wells,*" SPE/IADC 29385, Society of Petroleum Engineers, Copyright 1996, 11 pages.
Kelly Falk and Craig McDonald, "*An Overview of Underbalanced Drilling Applications in Canada,*" SPE 30129, Society of Petroleum Engineers, Copyright 1995, 9 pages.
"*Evolution Toward Simpler, Less Risky Multilateral Wells,*" World Oil , prepared from paper SPE/IADC 67825 by Adam Pasicznyk, Jun. 2001, 8 pages.
"*How Multilateral Boreholes Impact Ultimate Recovery Strategies,*" Offshore, Jul. 1997, 6 pages.
"*Trilateral Horizontal Wells Add 10 Million bbl for Unocal,*" Offshore, Dec. 1993, 2 pages.
Nicholas P. Chironis, "*New Borehole Techniques Offer Hope for Gassy Mines,*" Coal Age, Jan. 1973, 4 pages.
A. Retnanto, T.P. Frick, C.W. Brand, and M.J. Economides, "*Optimal Configurations of Multiple-Lateral Horizontal Wells,*" SPE 35712, Society of Petroleum Engineers, Copyright 1996 8 pages.
T.L. Logan, "*Horizontal Drainhole Drilling Techniques Used for Coal Seam Resource Exploitation,*" SPE 18254, Society of Petroleum Engineers, Copyright 1988, 13 pages.
David Hill, Eric Neme, Christine Enlig-Economides and Miguel Mollinedo, "*Reentry Drilling Gives New Life to Aging Fields,*" Oilfield Review, Autumn 1996, 14 pages.
R.L. Thoms and R.M. Gehle, "*Feasibility of Controlled Solution Mining From Horizontal Wells,*" Solution Mining Research Institute, Oct. 24-27, 1993, 8 pages.
"*World's First Trilateral Horizontal Wells on Stream,*" Oil & Gas Journal, Nov. 29, 1993, 2 pages.
Margaret A. Adams, Jeanne L. Hewitt and Rodney D. Malone, "*Coalbed Methane Potential of the Appalachians,*" SPE/DOE 10802, Society of Petroleum Engineers, Copyright 1982, 10 pages.
F.C. Schwerer and A.M. Pavone, "*Effect of Pressure-Dependent Permeability on Well-Test Analyses and Long-Term Production of Methane From Coal Seams,*" SPE/DOE/GRI 12857, Society of Petroleum Engineers, Copyright 1984, 10 pages.
Stephen Krickovic and J.D. Kalasky, "*Methane Emission Rate Study in a Deep Pocahontas No. 3 Coalbed Mine in Conjunction With Drilling Degasification Holes in the Coalbed,*" RI-7703, Bureau of Mines Report of Investigations/1972, United States Department of the Interior, 1972, 15 pages.
H.H. Fields, Joseph Cervik, and T.W. Goodman, "*Degasification and Production of Natural Gas From an Air Shaft in the Pittsburgh*

*Coalbed*," RI-8173, Bureau of Mines Report of Investigations/1976, United States Department of the Interior, 1976, 28 pages.
Gerald L. Finfinger and Joseph Cervik, "*Drainage of Methane From the Overlying Pocahontas No. 4 Coalbed From Workings in the Pocahontas No. 3 Coalbed,*" RI-8359, Bureau of Mines Report of Investigations/1979, United States Department of the Interior, 1979, 19 pages.
Gerald L. Finfinger and Joseph Cervik, "*Review of Horizontal Drilling Technology for Methane Drainage From U.S. Coalbeds,*" IC-8829, Bureau of Mines Information Circular/1980, United States Department of the Interior, 1980, 24 pages.
Andre P. Jourdan and Guy A. Baron, "*Elf Drills 1,000 + Ft Horizontally,*" Petroleum Engineer International, Sep. 1981, 4 pages.
P.F. Conti, "*Controlled Horizontal Drilling,*" SPE/IADC 18708, Society of Petroleum Engineers, Copyright 1989, 6 pages.
Armando R. Navarro, "*Innovative Techniques Cut Costs in Wetlands Drilling,*" Oil & Gas Journal, Oct. 14, 1991, 4 pages.
Victor M. Luhowy and Peter D. Sametz, "*Horizontal Wells Prove Effective in Canadian Heavy-Oil Field,*" Oil & Gas Journal, Jun. 28, 1993, 6 pages.
D. Lane Becker, "*Project Management Improved Multiwell Shallow Gas Development,*" Oil & Gas Journal, Oct. 16, 1995, 5 pages.
Mike R. Chambers, "*Junction Design Based on Operational Requirements,*" Oil & Gas Journal, Dec. 7, 1998, 7 pages.
A.J. Branch, et al., "*Remote Real-Time Monitoring Improves Orinoco Drilling Efficiency,*" Oil & Gas Journal, May 28, 2001, 6 pages.
D. Keith Murray, "*Deep Coals Hold Big Part of Resource,*" The American Oil & Gas Reporter, May 2002, 8 pages.
Nestor Rivera, et al., "*Multilateral, Intelligent Well Completion Benefits Explored,*" Oil & Gas Journal, Apr. 14, 2003, 10 pages.
Handbook On Coal Bed Methane Produced Water: Management And Beneficial Use Alternatives, prepared by ALL Consulting, Jul. 2003, 321 pages.
Nikola Maricic, "*Parametric and Predictive Analysis of Horizontal Well Configurations for Coalbed Methane Reservoirs in Appalachian Basin,*" Thesis, West Virginia University, Department of Petroleum and Natural Gas Engineering, 2004, 162 pages.
Nikola Maricic, Shahab D. Mohaghegn, and Emre Artun, "*A Parametric Study on the Benefits of Drilling Horizontal and Multilateral Wells in Coalbed Methane Reservoirs,*" SPE 96018, Society of Petroleum Engineers, Copyright 2005, 8 pages.
D.P. Schlick and J.W. Stevenson, "*Methane Degasification Experience at Jim Walter's,*" Proceedings of the Twelfth Annual Institute on Coal Mining Health, Safety and Research, Aug. 25-27, 1981, 9 pages.
P.C. Thakur, "*Optimum Methane Drainage in Gassy Coal Mines,*" 2003 SME Annual Meeting, copyright 2003 by SME, 4 pages.
Global Methane and the Coal Industry: A Two-Part Report on Methane Emissions from the Coal industry and Coalbed Methane Recovery and Use, Coal Industry Advisory Board, International Energy Agency, copyright 1994, 72 pages.
Paul F. Conti and Michael Schumacher, "Solution Mining in the Nineties," Presented at the Fall 1991 meeting of the Solution Mining Research Institute, Oct. 27-30, 1991, 11 pages.
Notification of Transmittal of the International Preliminary Report on Patentability (1 page), International Preliminary Report on Patentability (7 pages) and Amended Sheets (10 pages) for International Application No. PCT/US2004/012029 mailed Aug. 11, 2005.
Pratt et al., U.S. Patent Application entitled "Cavity Well System," S/N 11/141,335, May 31, 2005, 19 pages.

* cited by examiner

SLOT CAVITY

TECHNICAL FIELD OF THE INVENTION

The present invention relates generally to the field of subterranean exploration, and more particularly to a slot cavity.

BACKGROUND OF THE INVENTION

Subterranean deposits of coal contain substantial quantities of entrained methane gas limited in production in use of methane gas from coal deposits has occurred for many years. Substantial obstacles, however, have frustrated more extensive development and use of methane gas deposits in coal seams. Dual well systems have been used to aid in producing the methane gas from the coal seams. Such dual well systems may include two wellbores that intersect at a junction. In particular cases, an enlarged, cylindrical cavity is formed at a proposed junction to act as a target for the intersection of the wellbores.

SUMMARY OF THE INVENTION

The present invention provides a slot cavity that substantially eliminates or reduces at least some of the disadvantages and problems associated with previous cavities used in subterranean exploration.

In accordance with a particular embodiment of the present invention, a method for accessing a subterranean zone from the surface includes drilling a substantially vertical well bore from the surface to the subterranean zone and forming a slot cavity in the substantially vertical well bore proximate to the subterranean zone. The slot cavity comprises a substantially non-cylindrical shape. The method also includes drilling an articulated well bore from the surface to the subterranean zone. The articulated well bore is horizontally offset from the substantially vertical well bore at the surface and intersects the substantially vertical well bore at a junction proximate to the subterranean zone. The method may include drilling the articulated well bore to intersect the slot cavity of the substantially vertical well bore and drilling a substantially horizontal drainage pattern from the slot cavity into the subterranean zone. The subterranean zone may comprise a coal seam.

In accordance with another embodiment, a method for accessing a subterranean zone includes drilling a substantially vertical well bore from a surface to the subterranean zone and forming a slot cavity in the substantially vertical well bore at least partially within the subterranean zone. The slot cavity intersects at least one fracture of the subterranean zone and comprises a substantially non-cylindrical shape. The subterranean zone may comprise a coal seam. The method may also include draining gas from the at least one fracture. The at least one fracture may be naturally occurring or man-made.

Technical advantages of particular embodiments of the present invention include the formation of a slot-shaped cavity in a subterranean zone to provide a target for the intersection of an articulated well bore with a vertical well bore. The slot cavity has a cross-sectional area for intersection approximately equal to a cross-sectional cavity of other types of enlarged cavities which may be formed within the subterranean zone, such as generally cylindrical cavities. However, the volume of the slot cavity is generally less than the volume of other types of cavities such that the formation of the slot cavity requires less time and expense than the formation of other types of cavities.

Another technical advantage of particular embodiments of the present invention includes forming a slot cavity at least partially within a subterranean zone such that slot cavity intersects fractures of the subterranean zone. Intersecting the fractures with the slot cavity enables compositions included in or flowing through the fractures to be released into the slot cavity and drained to the surface. Thus, particular embodiments provide an improved method for accessing and draining compositions such as methane gas contained within a subterranean zone.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
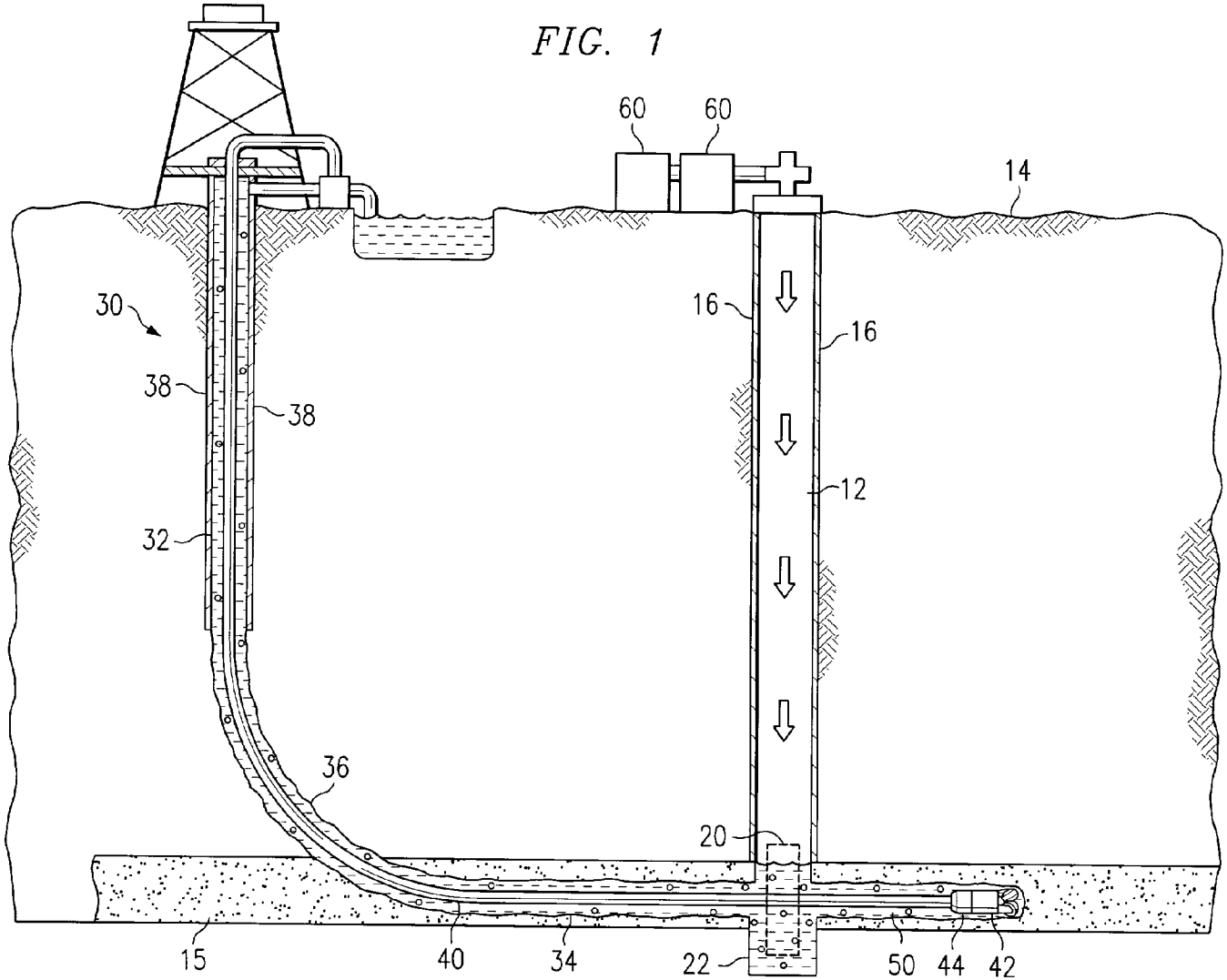
FIG. 1 illustrates an example dual well system for accessing a subterranean zone from the surface, in accordance with an embodiment of the present invention.

FIG. 1 illustrates an example dual well system for accessing a subterranean zone from the surface. In one embodiment, the subterranean zone may comprise a coal seam. In another embodiment, the subterranean zone may comprise an oil reserve. It will be understood that other subterranean zones can be similarly accessed using the dual well system of the present invention to remove and/or produce water, hydrocarbons and other fluids in the zone and to treat minerals in the zone prior to mining operations.

Referring to FIG. 1, a substantially vertical well bore 12 extends from a surface 14 to a target layer subterranean zone 15. Substantially vertical well bore 12 intersects, penetrates and continues below subterranean zone 15. Substantially vertical well bore 12 may be lined with a suitable well casing 16 that terminates at or above the level of the coal seam or other subterranean zone 15.

Figure 5:
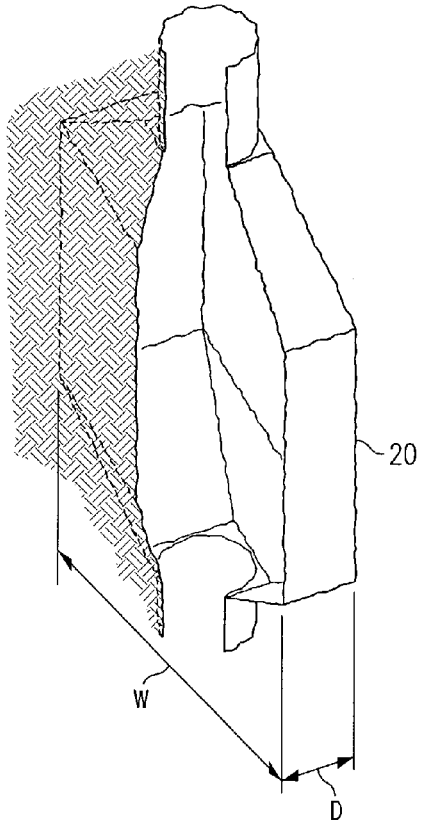
FIG. 5 is an isometric diagram illustrating a slot cavity, in accordance with an embodiment of the present invention.

A slot cavity 20 may be formed in substantially vertical well bore 12 at the level of subterranean zone 15. Slot cavity 20 is substantially non-cylindrical as illustrated in FIG. 5. As described in more detail below, slot cavity 20 provides a junction for intersection of substantially vertical well bore 12 by an articulated well bore used to form a drainage pattern in subterranean zone 15. Slot cavity 20 also provides a collection point for fluids drained from subterranean zone 15 during production operations.

In one embodiment, slot cavity 20 has a width of approximately sixteen feet, a thickness, or depth, of the substantially vertical well bore diameter and a vertical height which equals or exceeds the vertical dimension of subterranean zone 15. However, other embodiments may include a slot cavity having other dimensions. Slot cavity 20 is formed using suitable underreaming techniques and equipment. A vertical portion of substantially vertical well bore 12 may continue below slot cavity 20 to form a sump 22 for slot cavity 20. In particular embodiments, slot cavity 20 is oriented such that the cavity provides a target for another well bore, such as articulated well bore 30 (discussed below), to intersect during drilling.

An articulated well bore 30 extends from surface 14 to slot cavity 20 of substantially vertical well bore 12. Articulated well bore 30 includes a substantially vertical portion 32, a substantially horizontal portion 34, and a curved or radiused portion 36 interconnecting vertical and horizontal portions 32 and 34. Horizontal portion 34 lies substantially in the horizontal plane of subterranean zone 15 and intersects slot cavity 20 of substantially vertical well bore 12. Articulated well bore 30 is offset a sufficient distance from substantially vertical well bore 12 at surface 14 to permit curved portion 36 and any desired horizontal portion 34 to be drilled before intersecting slot cavity 20.

Articulated well bore 30 may be drilled using an articulated drill string 40 that includes a suitable down-hole motor and a drill bit 42. A measurement while drilling (MWD) device 44 may be included in articulated drill string 40 for controlling the orientation and direction of the well bore drilled by the motor and drill bit 42. The substantially vertical portion 32 of the articulated well bore 30 may be lined with a suitable casing 38. Other embodiments, may not include a casing or may include additional casing other than that illustrated.

After slot cavity 20 has been successfully intersected by articulated well bore 30, drilling is continued through slot cavity 20 using articulated drill string 40 and an appropriate horizontal drilling apparatus to provide a drainage pattern 50 in subterranean zone 15. In particular embodiments, a substantially vertical well bore and slot cavity may be located at or near the end of drainage pattern 50.

During the process of drilling drainage pattern 50, drilling fluid (such as drilling "mud") is pumped down the articulated drill string 40 and circulated out of drill string 40 in the vicinity of drill bit 42, where it is used to scour the formation and to remove formation cuttings. The cuttings are then entrained in the drilling fluid which circulates up through the annulus between drill string 40 and the well bore walls of articulated well bore 30 until it reaches surface 14, where the cuttings are removed from the drilling fluid. The fluid may then be recirculated. This conventional drilling operation may produce a column of drilling fluid in articulated well bore 30 having a vertical height equal to the depth of well bore 30 and may produce a hydrostatic pressure on the well bore corresponding to the well bore depth. Because coal seams tend to be porous and fractured, they may be unable to sustain such hydrostatic pressure. Accordingly, if the full hydrostatic pressure is allowed to act on the coal seam, the result may be loss of drilling fluid and entrained cuttings into the formation. Such a circumstance is referred to as an "over-balanced" drilling operation in which the hydrostatic fluid pressure in the well bore exceeds the ability of the formation to withstand the pressure. Loss of drilling fluids in cuttings into the formation is not only expensive in terms of the lost drilling fluids, which must be made up, but it tends to plug the pores in the coal seam, which are needed to drain the coal seam of gas and water.

To prevent over-balanced drilling conditions during formation of drainage pattern 50, air compressors 60 may be provided to circulate compressed air down the substantially vertical well bore 12 and back up through articulated well bore 30. The circulated air will admix with the drilling fluids in the annulus around articulated drill string 40 and create bubbles throughout the column of drilling fluid. This has the effect of lightening the hydrostatic pressure of the drilling fluid and reducing the down-hole pressure sufficiently that drilling conditions do not become over-balanced. Aeration of the drilling fluid may reduce down-hole pressure to approximately 150–200 pounds per square inch (psi) in particular embodiments. Accordingly, low pressure coal seams and other subterranean zones can be drilling without substantial loss of drilling fluid and contamination of the zone by the drilling fluid.

Foam, which may include compressed air mixed with water, may be circulated down through articulated drill string 40 along with the drilling mud in order to aerate the drilling fluid in the annulus as articulated well bore 30 is being drilled and, if desired, as drainage pattern 50 is being drilled. Drilling of drainage pattern 50 with the use of an air hammer bit or an air-powered down-hole motor will also supply compressed air or foam to the drilling fluid. In this case, the compressed air or foam which is used to power the bit or down-hole motor exits the vicinity of drill bit 42. However, the larger volume of air which can be circulated down substantially vertical well bore 12, permits greater aeration of the drilling fluid than is generally possible by air supplied through articulated drill string 40.

Figure 2:
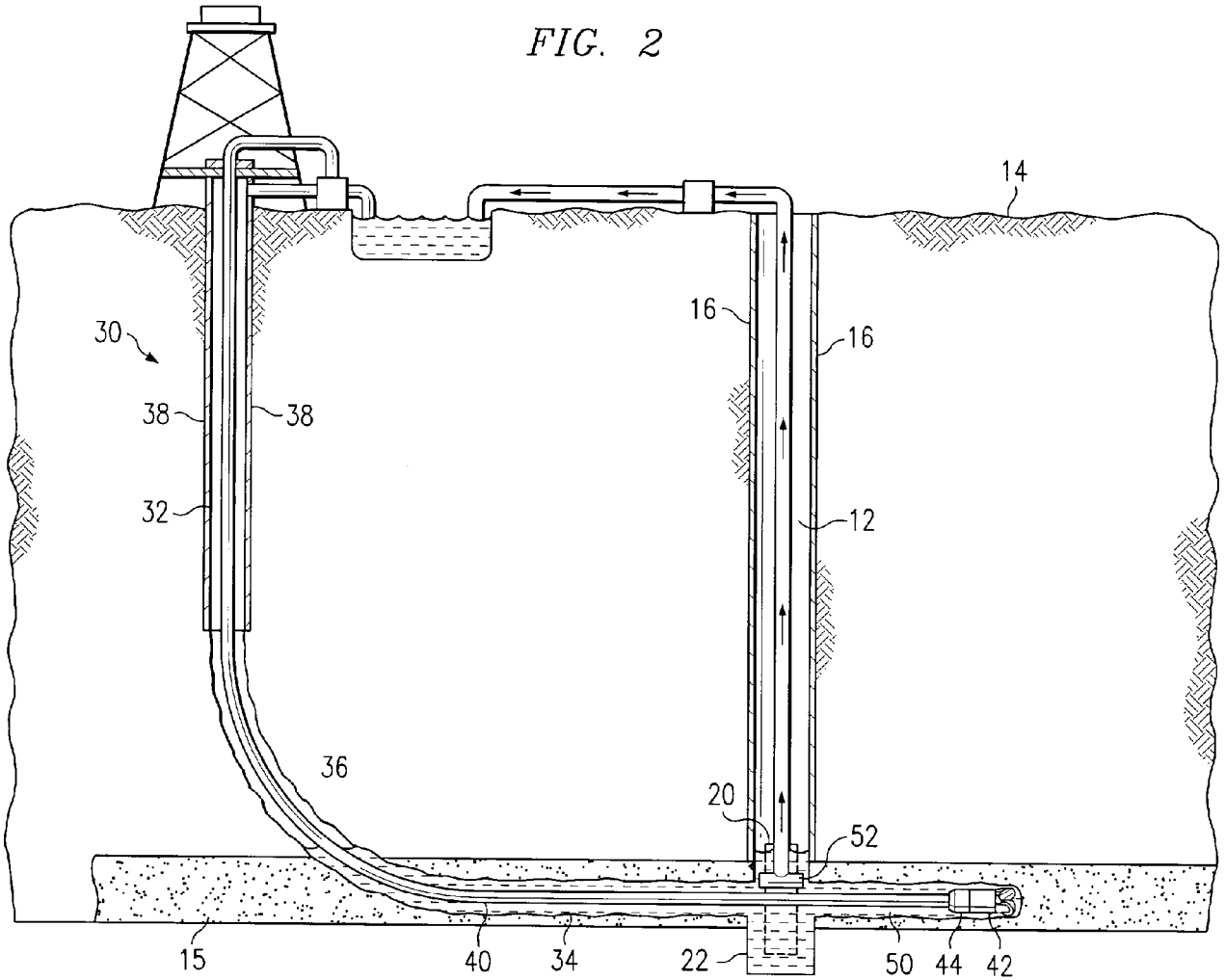
FIG. 2 illustrates an example slot cavity and articulated well combination for accessing a subterranean zone from the surface, in accordance with an embodiment of the present invention.

FIG. 2 illustrates an example slot cavity and articulated well combination for accessing a subterranean zone from the surface. In this embodiment, substantially vertical well bore 12, slot cavity 20 and articulated well bore 30 are positioned and formed as previously described in connection with FIG. 1. FIG. 2 illustrates an example of another manner in which fluids may be circulated in a dual well system. Other ways of circulating fluids may be used as well.

Referring to FIG. 2, after intersection of slot cavity 20 by articulated well bore 30, a pump 52 is installed in slot cavity 20 to pump drilling fluid and cuttings through substantially vertical well bore 12 to surface 14. This may reduce the friction of air and fluid returning up articulated well bore 30 and reduce down-hole pressure to nearly zero. Accordingly, coal seams and other subterranean zones having low pressures can be accessed from the surface. Additionally, the risk of combining air and methane from the coal seam in the well is reduced.

Figure 3:
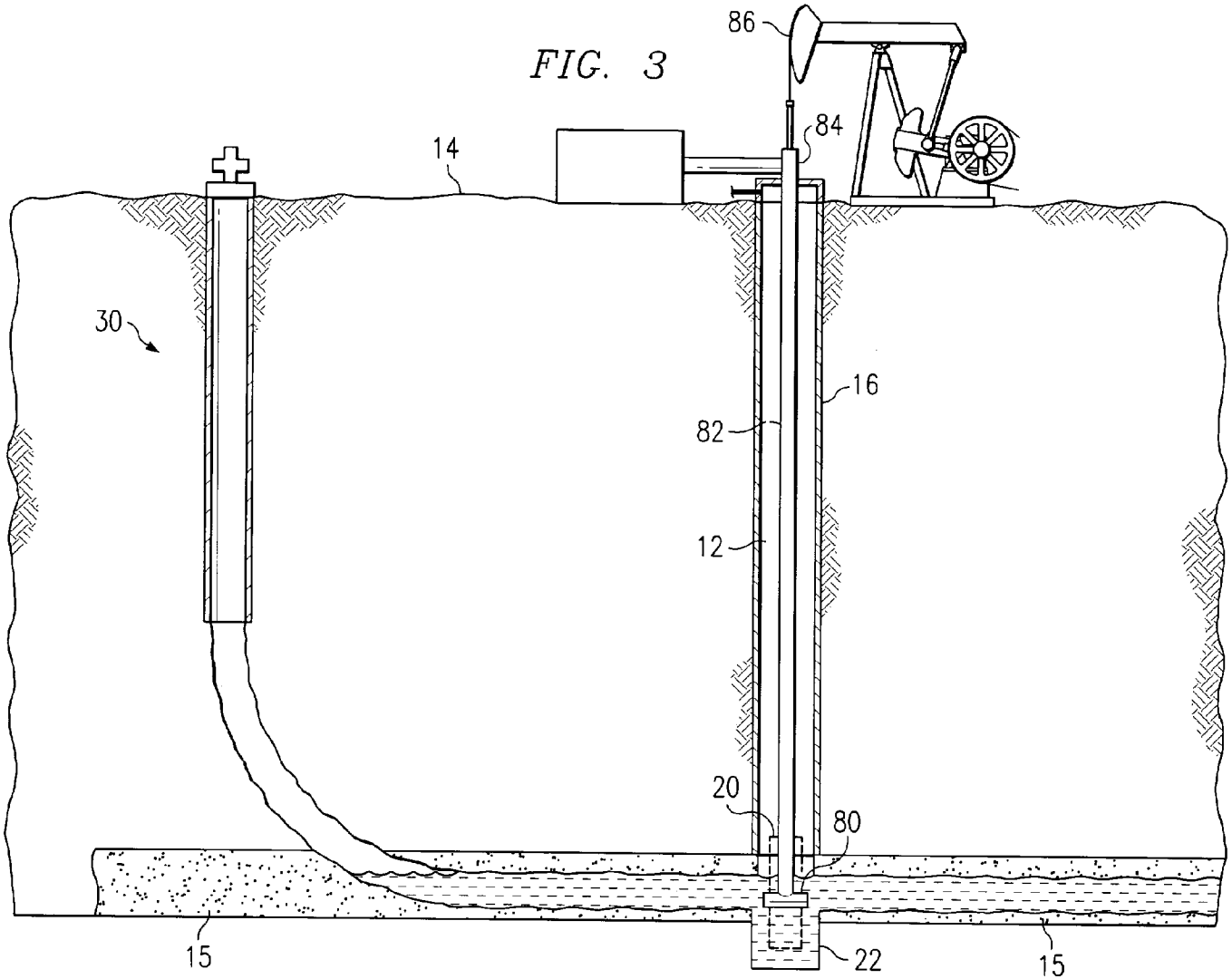
FIG. 3 illustrates an example system for the production of fluids from the slot cavity and articulated well combination, in accordance with an embodiment of the present invention.

FIG. 3 is a cross-sectional diagram of an example system for the production of fluids from the slot cavity and articulated well combination. In this embodiment, after substantially vertical and articulated well bores 12 and 30 and the desired drainage pattern have been drilled, articulated drill string 40 is removed from articulated well bore 30, and the articulated well bore is capped. A down hole pump 80 is disposed in substantially vertical well bore 12 in slot cavity 20. Slot cavity 20 provides a reservoir for accumulated fluids from subterranean zone 15.

Down hole pump 80 is connected to surface 14 via a tubing string 82 and may be powered by sucker rods 84 extending down through well bore 12 of the tubing. Sucker rods 84 are reciprocated by a suitable surface mounted apparatus, such as a powered walking beam 86 to operate down hole pump 80. Down hole pump 80 is used to remove water and entrained coal fines from subterranean zone 15 via the drainage pattern. Once the water is removed to the surface, it may be treated to remove methane dissolved in the water and entrained fines. After sufficient water has been removed from subterranean zone 15, gas may be allowed to flow to surface 14 through the annulus of the substantially vertical well bore 12 around tubing string 82 and may be removed via piping attached to a wellhead apparatus. At surface 14, the methane may be treated, compressed and pumped through a pipeline for use as a fuel in a conventional manner. Down hole pump 80 may be operated continuously or as needed to remove water drained from the coal seam into slot cavity 20.

Figure 4:
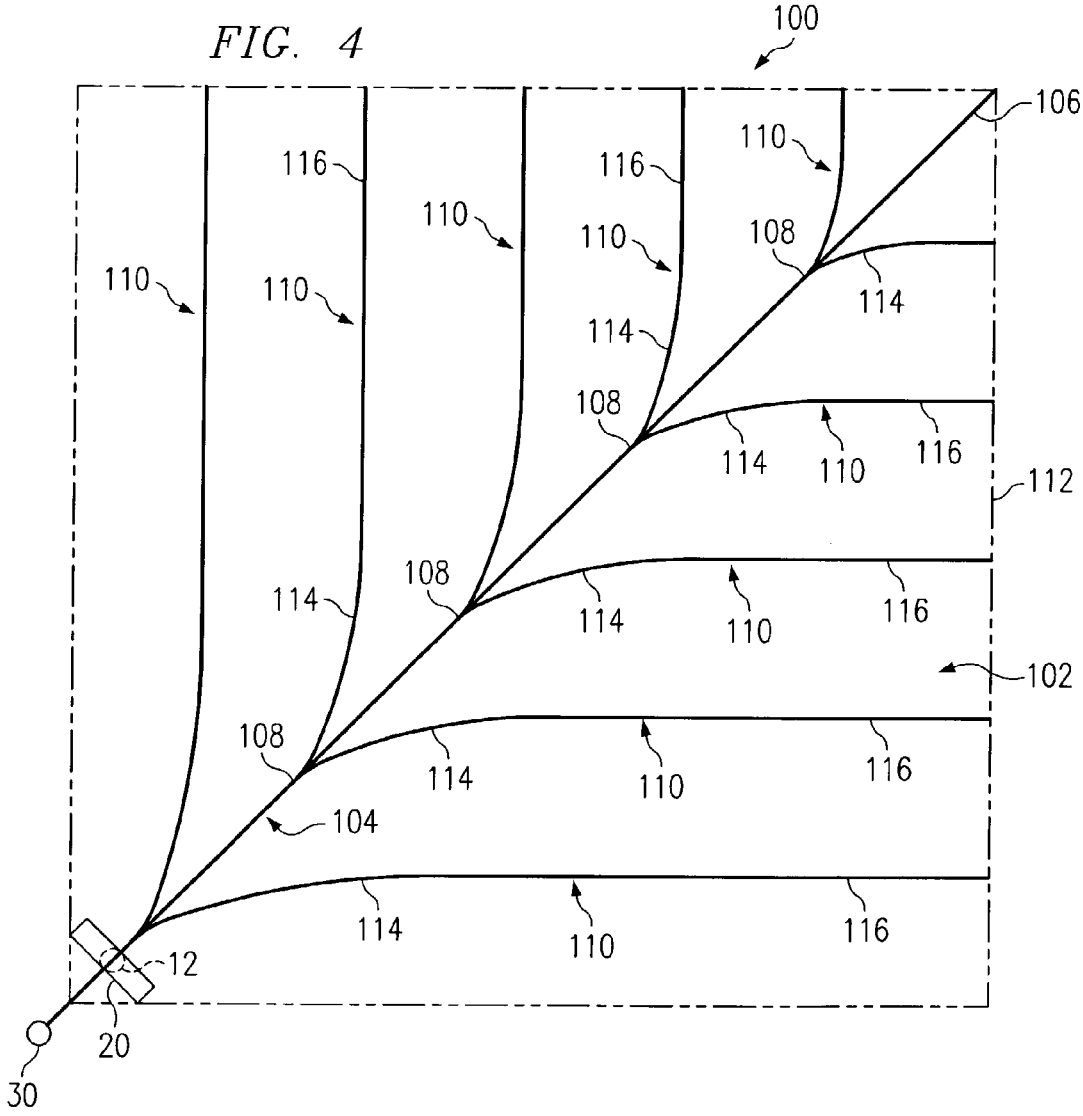
FIG. 4 illustrates an example pinnate drainage pattern for accessing deposits in a subterranean zone, in accordance with an embodiment of the present invention.

FIG. 4 is a top plan diagram illustrating an example pinnate drainage pattern for accessing deposits in a subterranean zone. The drainage pattern may comprise a pinnate pattern that has a main drainage well bore 104 with generally symmetrically arranged and appropriately spaced lateral well bores 110 extending from each side of the main drainage well bore. The pinnate pattern approximates the pattern of veins in a leaf or the design of a feather in that it has similar, substantially parallel, lateral drainage bores 110 arranged in substantially equal and parallel spacing or opposite sides of an axis. The pinnate drainage pattern with its main drainage well bore 104 and generally symmetrically arranged and appropriately spaced lateral drainage bores 110 on each side provides a uniform pattern for draining fluids from a coal seam or other subterranean formation. The pinnate pattern may provide substantially uniform coverage of a square, other quadrilateral, or grid area and may be aligned with longwall mining panels for preparing subterranean zone 15 for mining operations. It will be understood that other suitable drainage patterns may be used in accordance with the present invention.

The pinnate and other suitable drainage patterns drilled from the surface provide surface access to subterranean formations. The drainage pattern may be used to uniformly remove and/or insert fluids or otherwise manipulate a subterranean deposit. In non-coal applications, the drainage pattern may be used initiating in-situ burns, "huff-puff" steam operations for heavy crude oil, and the removal of hydrocarbons from low porosity reservoirs.

Referring to FIG. 4, pinnate drainage pattern 100 provides access to a substantially square area 102 of a subterranean zone. A number of the pinnate patterns 100 may be used together to provide uniform access to a large subterranean region.

Slot cavity 20 defines a first corner of area 102. Pinnate pattern 100 includes a substantially horizontal main drainage well bore 104 extending diagonally across area 102 to a distant corner 106 of area 102. One skilled in the art may recognize, however, that the substantially horizontal main drainage well bore 104 need not be precisely horizontal where the subterranean zone itself is not precisely horizontal. Rather, substantially horizontal merely means that well bore 104 is in conformance with the shape of subterranean zone 15. If subterranean zone 15 is sloping toward the earth's surface, the substantially horizontal main drainage well bore 104 may also slope toward the earth's surface in conformance with the plane of subterranean zone 15. In particular embodiments, the substantially vertical and articulated well bores 12 and 30 may be positioned over area 102 such that the main drainage well bore 104 is drilled up the slope of subterranean zone 15. This may facilitate collection of water and gas from area 102. Main drainage well bore 104 is drilled using articulated drill string 40 and extends from slot cavity 20 in alignment with articulated well bore 30.

A plurality of lateral well bores 110 may extend from opposite sides of main drainage well bore 104 to a periphery 112 of area 102. Lateral bores 110 may mirror each other on opposite sides of the main drainage well bore 104 or may be offset from each other along main drainage well bore 104. Each of the lateral bores 110 includes a curved portion 114 coming off of main drainage well bore 104 and an elongated portion 116 formed after curved portion 114 has reached a desired orientation. For uniform coverage of area 102, pairs of lateral bores 110 may be substantially evenly spaced on each side of main drainage well bore 104 and extend from main drainage well bore 104 at an angle of approximately 45 degrees. Lateral bores 110 may shorten in length based on progression away from slot cavity 20 in order to facilitate drilling of lateral bores 110.

In a particular embodiment, a pinnate drainage pattern 100 including a main drainage well bore 104 and five pairs of lateral bores 110 may drain a subterranean zone 15 of approximately 150 acres in size. Where a smaller area is to be drained, or where subterranean zone 15 has a different shape, such as a long, narrow shape or due to surface or subterranean topography, alternate pinnate drainage patterns may be employed by varying the angle of lateral bores 110 to main drainage well bore 104 and the orientation of lateral bores 110. Alternatively, lateral bores 120 can be drilled from only one side of the main drainage well bore 104 to form a one-half pinnate pattern.

Main drainage well bore 104 and lateral bores 110 are formed by drilling through slot cavity 20 using articulated drill string 40 and appropriate horizontal drilling apparatus. During this operation, gamma ray logging tools and conventional MWD technologies may be employed to control the direction and orientation of the drill bit so as to retain the drainage pattern within the confines of subterranean zone 15 and to maintain proper spacing and orientation of main drainage well bore and lateral bores 104 and 110.

FIG. 5 is an isometric diagram illustrating an example slot cavity 20. As stated above, slot cavity 20 is substantially non-circular and thus does not comprise a generally rounded or cylindrical shape. In this embodiment, slot cavity 20 has a depth D that is generally less than a width W of the slot cavity. The ratio of width W to depth D may vary in different embodiments.

The formation of slot cavity 20 provides a target for the intersection of articulated well bore 30 with substantially vertical well bore 12. Slot cavity 20 has a cross-sectional area for intersection approximately equal to a cross-sectional cavity of other types of enlarged cavities which may be formed within the subterranean zone, such as generally cylindrical cavities. However, the volume of the slot cavity is generally less than the volume of other types of cavities such that the formation of the slot cavity requires less time and expense than the formation of other types of cavities.

Figure 6:
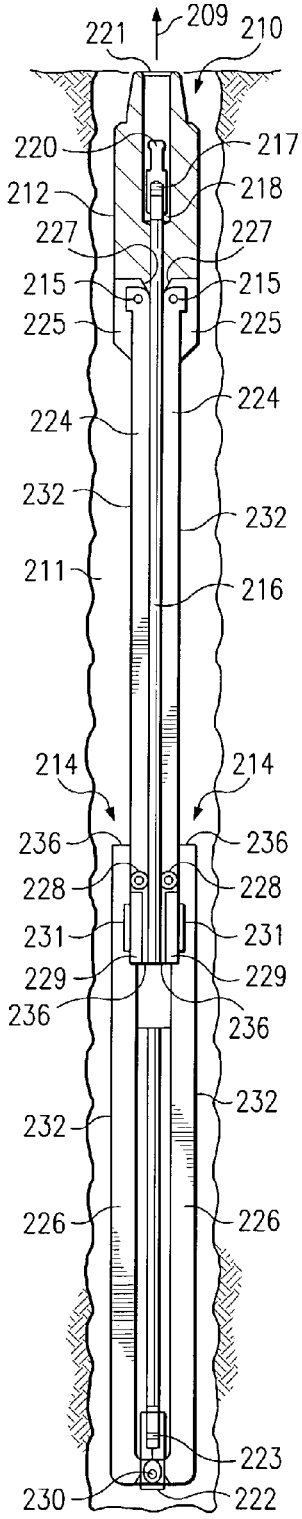
FIG. 6 illustrates an example underreamer used to form a slot cavity, in accordance with an embodiment of the present invention.

FIG. 6 illustrates an example underreamer 210 used to form a slot cavity, such as slot cavity 20 of FIG. 5. Underreamer 210 includes two cutter sets 214 pivotally coupled to a housing 212. Other underreamers which may be used to form slot cavity 20 may have one or more than two cutter sets. Housing 212 is illustrated as being substantially vertically disposed within a well bore 211. In this embodiment, each of cutter sets 214 is pivotally coupled to housing 212 via a pin 215; however, other suitable methods may be used to provide pivotal or rotational movement of cutter sets 214 relative to housing 212.

Underreamer 210 also includes an actuation rod 216 slidably positioned within an internal passage 218 of housing 212. Actuation rod 216 includes a fishing neck 220 coupled to an end 217 of actuation rod 216. Housing 212 includes a recess 221 capable of receiving fishing neck 220 while underreamer 210 is in the retracted position. Fishing neck 220 is operable to engage a fishing tool lowered within well bore 211 to which an axial force is applied, which in turn slides actuation rod 216 relative to housing 212. The axial force is a force in a direction along the longitudinal axis of actuation rod 216. Such direction is illustrated on FIG. 6 by arrow 209. The fishing tool can be a 1½" jar down to shear tool; however, other suitable techniques may be used to slide actuation rod 216 relative to housing 212, such as a hydraulic piston mechanism.

Each cutter set 214 contains a first cutter 224 and a second cutter 226. Other underreamers used to form a slot cavity such as slot cavity 20 may include cutter sets having one or more than two cutters. Each first cutter 224 and each second cutter 226 is nested around actuation rod 216 when underreamer 210 is in the retracted position; however, cutters of other underreamers used to form a slot cavity may not be nested around an actuation rod in a retracted position. Each first cutter 224 is pivotally coupled to a respective second cutter 226. A pivot block 229 may also be coupled to first cutters 224 and second cutters 226 in order to protect the connection between first cutters 224 and second cutters 226 from failure due to contact with exposed surfaces of well bore 211. In the illustrated embodiment, each first cutter 224 is pivotally coupled to a second cutter 226 and a pivot block 229 via a pin 228; however, other suitable methods may be used to provide pivotal or rotational movement of first and second cutters 224 and 226 relative to one another. Pivot block 229 may also include a dove tail 231 which is coupled to second cutters 226 using a bolt or weld or any other suitable method of connection.

The locations on each first cutter 224 and second cutter 226 where cutters 224 and 226 are coupled may be at a point that is not at the ends of first cutter 224 and/or second cutter 226. Coupling first and second cutters 224 and 226 at a location other than their ends can shield and protect pins 228 during rotation of underreamer 210 since pins 228 would not be in contact with exposed surfaces of the well bore during rotation. Coupling first and second cutters 224 and 226 at such locations also allows for the tips of cutters 224 and 226 to absorb much of the wear and tear from contact with well bore 211. In particular embodiments, the tips may be replaced as they get worn down during operation of underreamer 210 and may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation.

Each second cutter 226 may be pivotally coupled to a connector 222 which is pivotally coupled to an end 223 of actuation rod 216. In the illustrated embodiment, each of second cutters 226 is pivotally coupled to connector 222 via a pin 230; however, other suitable methods may be used to provide pivotal or rotational movement of second cutters 226.

In the illustrated embodiment, housing 212 also includes outwardly facing recesses 225 which are each adapted to receive a cutter set 214. Housing 212 may have a bevel 227 at each recess 225 in order to restrict and prevent too much rotational movement of first cutters 224 when actuation rod 216 moves in response to the axial force.

Each of first cutters 224 and second cutters 226 comprises an outwardly disposed cutting surface 232 and an end cutting surface 236. Cutting surfaces 232 and 236 may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation. Additionally, various cutting surfaces 232 and 236 configurations may be machined or formed on first cutters 224 or second cutters 226 to enhance the cutting characteristics of first cutters 224 or second cutters 226.

Figure 7:
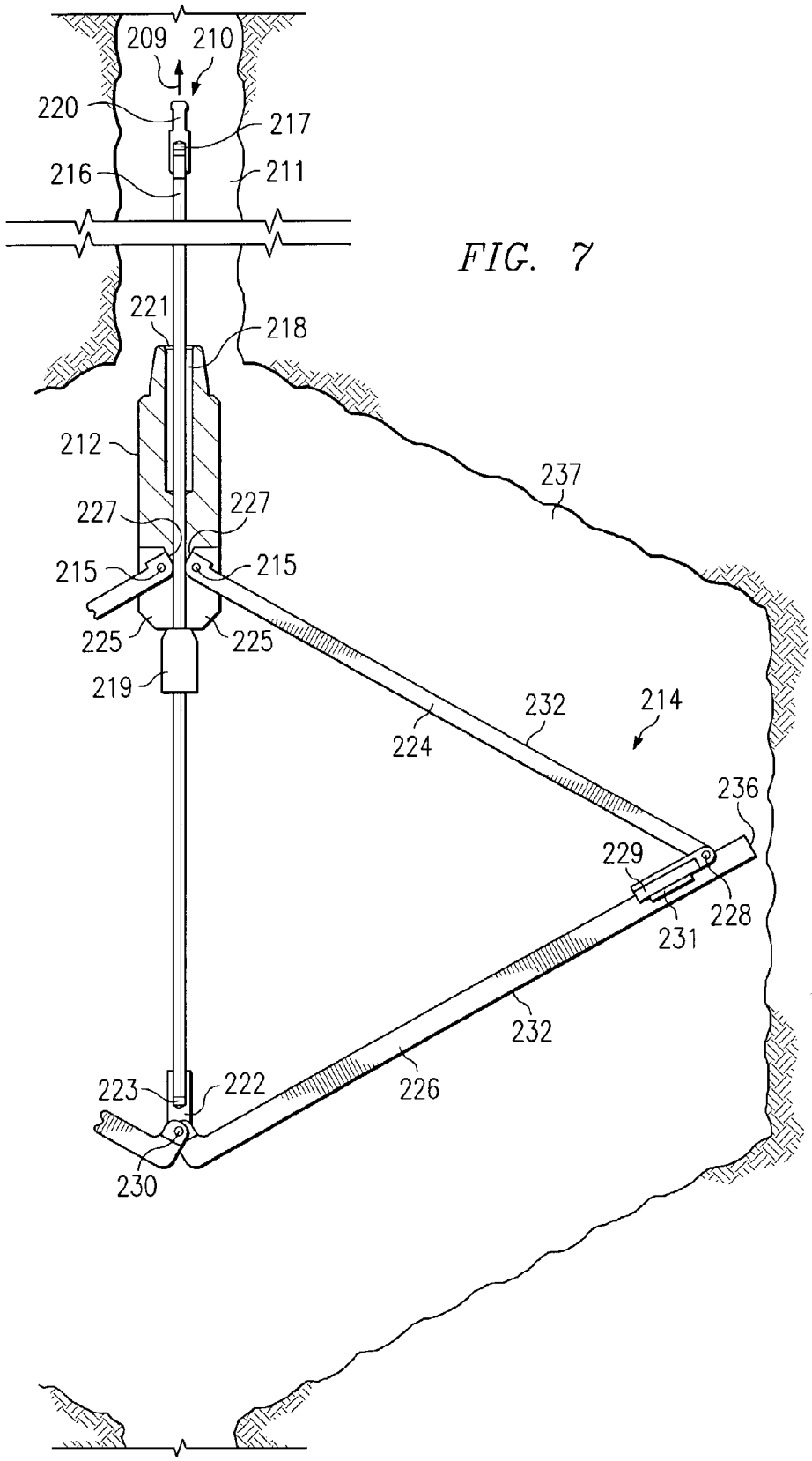
FIG. 7 illustrates the underreamer of FIG. 6 with cutter sets disposed in an extended position, in accordance with an embodiment of the present invention.

FIG. 7 is a diagram illustrating underreamer 210 illustrated in FIG. 6 having cutter sets 214 disposed in an extended position relative to housing 212. In FIG. 7, actuation rod 216 is illustrated in an upwardly disposed position relative to housing 212.

In response to movement of actuation rod 216 relative to housing 212, first cutters 224 rotate about pins 215 and second cutters 226 rotate about pins 230 extending cutter sets 214 radially outward relative to housing 212. An actuation block 219 coupled to actuation rod 216 assists cutters 224 and 226 in beginning their extensions from their retracted positions when actuation rod 216 begins moving relative to housing 212.

As actuation rod 216 moves relative to housing 212, actuation block 219 comes into contact with pivot blocks 229, beginning the extension of cutter sets 214 radially outward. Through extension of the cutter sets via the movement of actuation rod 216 relative to housing 212, underreamer 210 forms an slot cavity 237 as cutting surfaces 232 and 236 come into contact with the surfaces of well bore 211. Underreamer 210 may be moved in the general direction of arrow 209 as well as in the opposite direction when the cutter sets are in a semi-extended or extended position in order to define and shape cavity 237 into a slot cavity. Such movement may be accomplished by a drill string coupled to housing 212 or by other suitable means. The drill string may also aid in stabilizing housing 212 in well bore 211. It should be understood that a slot cavity having a shape other than the shape of cavity 237 may be formed with underreamer 210.

Other types of underreamers may also be used to form a slot cavity similar to slot cavity 20 of FIG. 5. For example, other suitable underreamers may not include an actuation block for aiding in the extension of the cutters from a retracted portion. Particular underreamers may include an actuator having a wedge member or other portion to aid in extending the cutters. As stated above, some underreamers may utilize a hydraulic piston or other mechanism for extension of the cutters.

Figure 8:
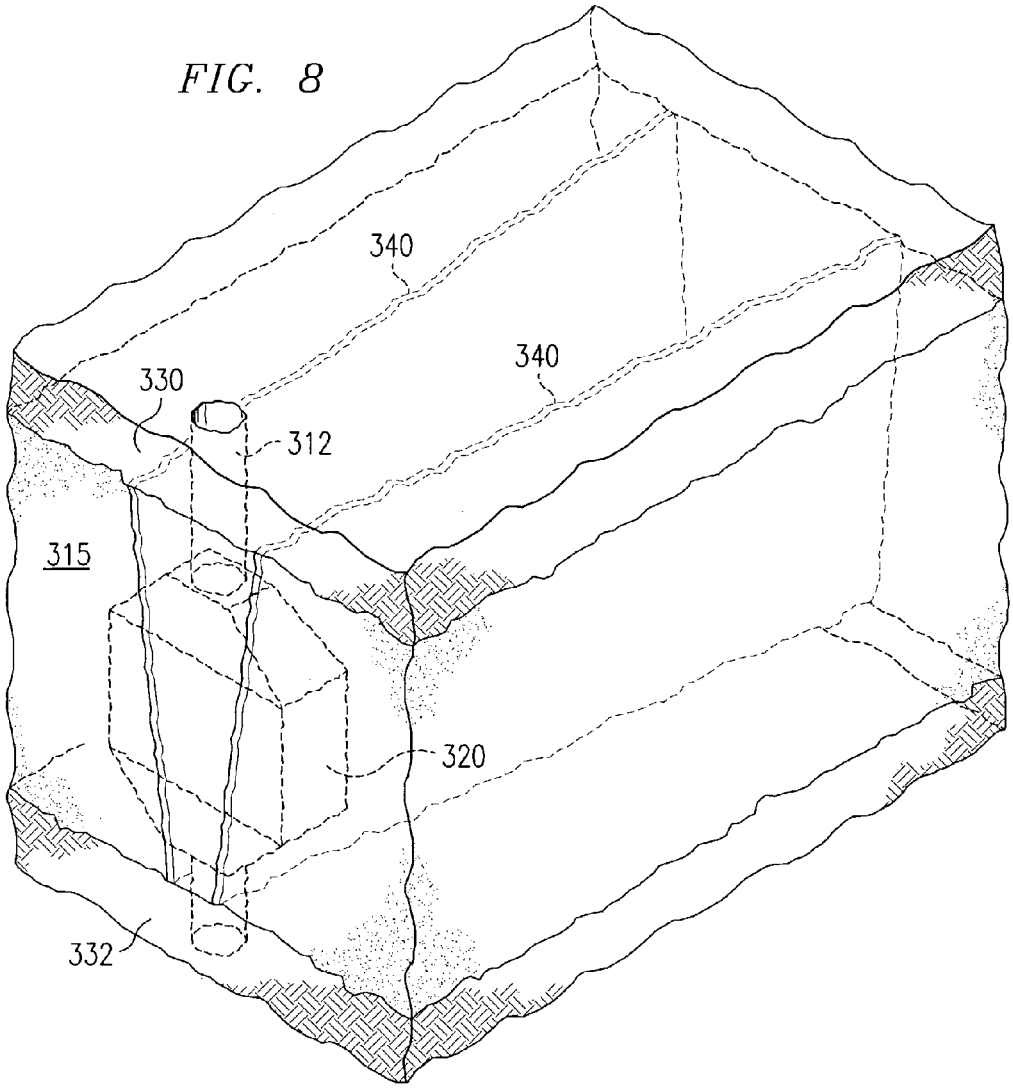
FIG. 8 illustrates an example slot cavity formed within a subterranean zone, in accordance with an embodiment of the present invention.

FIG. 8 illustrates an example slot cavity 320 formed within a subterranean zone 315. Slot cavity 320 is formed in a substantially vertical well bore 312. Slot cavity 320 may be formed using an underreamer, such as underreamer 210 of FIGS. 5 and 6, or by any other suitable methods or techniques. In the illustrated embodiment, subterranean zone 315 comprises a coal seam; however, other types of subterranean zones may be accessed in other embodiments.

Subterranean zone 315 is bounded by an upper boundary layer 330 and a lower boundary layer 332. Upper and lower boundary layers 330 and 332 may comprise sandstone, shale, limestone or other suitable rock and/or mineral strata.

Subterranean zone 315 comprises fractures 340 which may include methane gas, air or another composition. Fractures 340 may allow for the flow of such compositions from subterranean zone 315 to slot cavity 320. Fractures 340 may be naturally occurring or may be artificially formed or man-made in subterranean zone 315. In the present embodiment, subterranean zone 315 is illustrated as comprising two fractures 340, both configured substantially vertically. However, subterranean zones 315 in accordance with other embodiments may include any number of fractures 340. Furthermore, such fractures 340 may comprise any shape, size or configuration. In particular embodiments, fractures 340 may exist approximately 2 to 20 feet apart from each other and may have various widths.

Forming slot cavity 320 at least partially within subterranean zone 315 enables slot cavity 320 to intersect fractures 340 so that compositions present in or flowing through fractures 340 may be drained from subterranean zone 15. For example, if methane gas is present in fractures 340, intersecting fractures 340 with slot cavity 320 enables the methane gas in fractures 340 to be released into slot cavity 320 and drained to the surface. Thus, particular embodiments provide an improved method for accessing and draining compositions such as methane gas contained within a subterranean zone.

Figure 9A:
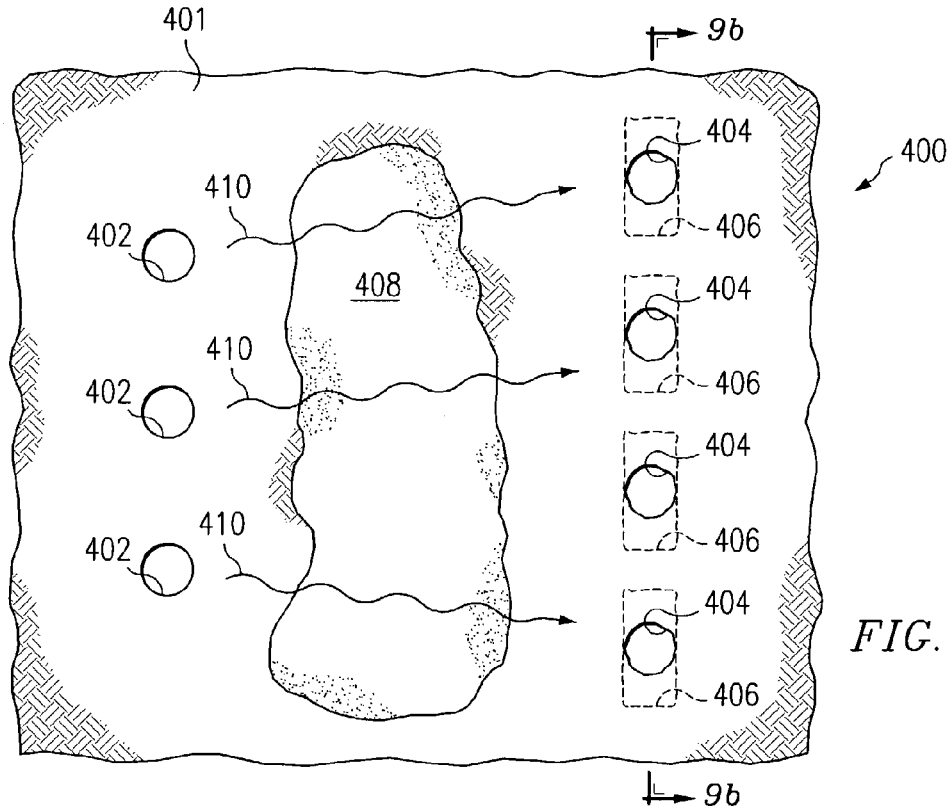
FIGS. 9A and 9B illustrate an example well system utilizing slot cavities, in accordance with another embodiment of the present invention.
Figure 9B:
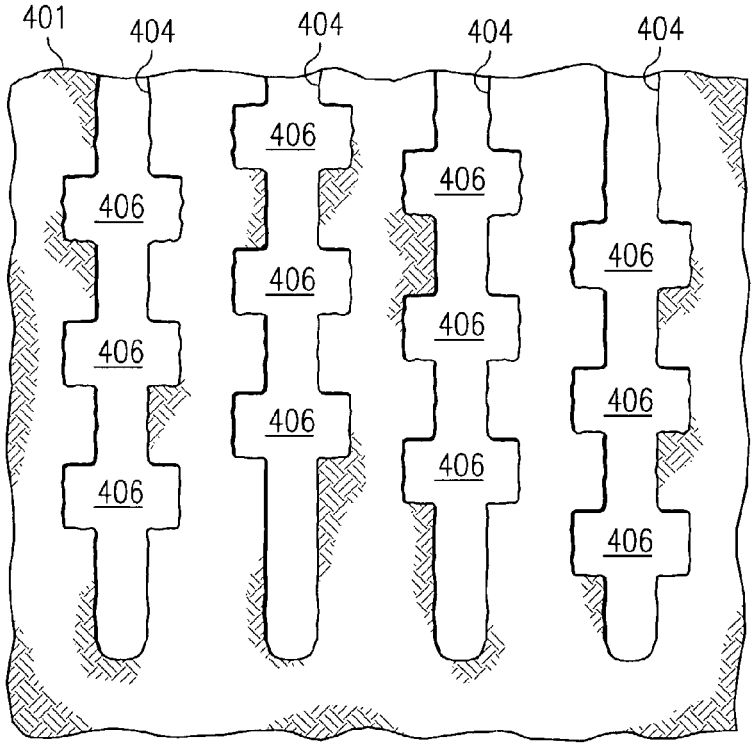

FIGS. 9A and 9B illustrate a well system 400 utilizing slot cavities in accordance with another embodiment of the present invention. FIG. 9A is a top view looking down on a surface 401. Drilled into surface 401 are substantially vertical driver well bores 402 and substantially vertical collector well bores 404. Substantially vertical well bores 404 include slot cavities 406 which may be formed using the various methods described above or otherwise. As further described below, each substantially vertical well bore 404 includes one or more slot cavities formed at various depths beneath surface 401. It should be understood that the number and relative size or spacing of substantially vertical well bores 402 and 404, and the number and size of slot cavities 406, may vary according to different embodiments.

The material beneath surface 401 may comprise any underground material, such as sand, coal or other composition. A fluid 408 is located in one or more reservoirs, fractures or pores of the material beneath surface 401. Fluid 408 may comprise a contaminant or other composition. For example, fluid 408 may comprise a pollutant that has seeped into the material beneath surface 401.

A treatment solution may be pumped down substantially vertical well bores 402 in order to drive fluid 408 towards slot cavities 406 and substantially vertical well bores 404, as indicated by arrows 410. The treatment solution may comprise a liquid or gas comprising carbon dioxide, nitrogen, air, steam or other material. The fluid 408 may be driven through the material beneath surface 401 by the treatment solution because of the relative permeability of the material. Fluid 408, driven by the treatment solution, may collect in slot cavities 406 and substantially vertical well bores 404 for treatment or retrieval by pumping or other means.

FIG. 9B is a cross-sectional view of system 400 of FIG. 9A taken along line 9*b*—9*b*. As illustrated in FIG. 9B, substantially vertical collector well bores 404 include slot cavities 406 formed at various depths below surface 401. As described above, fluid may be driven to collect in slot cavities 406 and substantially vertical well bores 404 for retrieval or treatment. The use of slot cavities 406 in such a manner facilitates the retrieval of fluids located beneath surface by increasing the area to which the fluids may be driven for collection over such area in a system without slot cavities.

It should be understood that the particular number or configuration of slot cavities, in relation to substantially vertical well bores 404 or otherwise, may vary in different embodiments. For example, one substantially vertical well bore 404 may include any number of slot cavities 406 and such number may be different than the number of slot cavities 406 formed in another substantially vertical well bore 404. Moreover, the sizes and spacing of such slot cavities and depths at which each slot cavity is formed may vary with respect to different substantially vertical well bores 404.

Although the present invention has been described in detail, various changes and modifications may be suggested to one skilled in the art. It is intended that the present invention encompass such changes and modifications as falling within the scope of the appended claims.

What is claimed is:

1. A method for accessing a subterranean zone from the surface, comprising:

drilling a substantially vertical well bore from the surface to the subterranean zone;

forming a slot cavity in the substantially vertical well bore proximate to the subterranean zone, wherein the slot cavity comprises a substantially non-cylindrical shape; and drilling an articulated well bore to the subterranean zone horizontally offset from the substantially vertical well bore and intersecting the slot cavity of the substantially vertical well bore at a junction proximate to the subterranean zone and extending beyond the slot cavity.

2. The method of claim 1, further comprising:

drilling a substantially horizontal drainage pattern from the slot cavity into the subterranean zone.

3. The method of claim 1, wherein the subterranean zone comprises a coal seam.

4. The method of claim 1, wherein the subterranean zone comprises an oil reservoir.

5. The method of claim 1, further comprising:

drilling a substantially horizontal drainage pattern from the junction into the subterranean zone; and producing fluid from the subterranean zone through the substantially vertical well bore.

6. The method of claim 1, further comprising:

drilling a substantially horizontal diagonal well bore from the junction defining a first set of an area in the subterranean zone to a distant end of the area;

drilling a first set of substantially horizontal lateral well bores in space relation to each other from the diagonal to the periphery of the area on a first side of the diagonal well bore; and drilling a second set of substantially horizontal lateral well bores in space relation to each other from the diagonal well bore to the periphery of the area on a second, opposite side of the diagonal well bore.

7. The method of claim 1, wherein forming a slot cavity in the substantially vertical well bore proximate to the subterranean zone comprises:

positioning an underreamer within the well bore, the underreamer having a plurality of cutter sets;

extending the cutter sets radially outward from a retracted position; and moving the underreamer within the well bore to form the cavity.

8. A system for accessing a subterranean zone from the surface, comprising:

a substantially vertical well bore extending from the surface to the subterranean zone;

a slot cavity formed in the substantially vertical well bore proximate to the subterranean zone, wherein the slot cavity comprises a substantially non-cylindrical shape; and an articulated well bore extending to the subterranean zone, the articulated well bore horizontally offset from the substantially vertical well bore and intercepting the slot cavity at a junction proximate to the subterranean zone and extending beyond the slot cavity.

9. The system of claim 8, further comprising a substantially horizontal drainage pattern extending from the junction into the subterranean zone.

10. The system of claim 8, wherein the subterranean zone comprises a coal seam.

11. The system of claim 8, wherein the subterranean zone comprises an oil reservoir.

12. The system of claim 8, the substantially horizontal drainage pattern comprising:

a substantially horizontal diagonal well bore extending from the junction defining a first end of an area in the subterranean zone to a distant end of the area;

a first set of substantially horizontal lateral well bores in space relation to each other extending from the diagonal to the periphery of the area on a first side of the diagonal well bore; and a second set of substantially horizontal lateral well bores in space relation to each other extending from the diagonal to the periphery of the area on a second, opposite side of the diagonal well bore.

13. A method for preparing a subterranean zone for mining, comprising:

drilling a substantially vertical well bore from the surface to the subterranean zone;

forming a slot cavity in the substantially vertical well bore, the slot cavity comprising a substantially non-cylindrical shape;

drilling an articulated well bore to the subterranean zone to intersect the slot cavity at a junction proximate to the subterranean zone and extend beyond the slot cavity;

drilling a substantially horizontal drainage pattern from the junction into the subterranean zone;

draining water from the subterranean zone through the drainage pattern into the junction;

pumping the water from the junction to the surface through the substantially vertical well bore; and producing gas from the subterranean zone through at least one of the substantially vertical and articulated well bores.

14. The method of claim 13, wherein the subterranean zone comprises a coal seam.

15. The method of claim 13, further comprising:

installing a substantially vertical rod pumping unit in the substantially vertical well bore with a pump inlet position proximate to the junction; and pumping water from the junction to the surface through the substantially vertical rod pumping unit.

16. The method of claim 13, drilling the substantially horizontal draining pattern from the junction comprising:

drilling a diagonal well bore from the junction defining a first end of an area aligned with a subterranean coal panel to an opposite corner of the area;

drilling a plurality of lateral well bores on each side of the diagonal well bore into one or more coal panels.

17. The method of claim 16, wherein the draining pattern comprises a pinnate structure.

18. A method for accessing a subterranean zone, comprising:

drilling a substantially vertical well bore from a surface to the subterranean zone; and forming a slot cavity in the substantially vertical well bore at least partially within the subterranean zone for collecting fluid drained from the subterranean zone, the slot cavity intersecting at least one preexisting fracture of the subterranean zone, wherein the slot cavity comprises a substantially non-cylindrical shape.

19. The method of claim 18, wherein the subterranean zone comprises a coal seam.

20. The method of claim 18, further comprising draining gas from the at least one fracture.

21. The method of claim 18, wherein the at least one fracture is naturally occurring.

22. The method of claim 18, wherein the at least one fracture is man-made.

23. A method for retrieval of subsurface fluid, comprising:

drilling one or more substantially vertical driver well bores from the surface into an underground material, wherein the underground material includes a fluid;

drilling one or more substantially vertical collector well bores from the surface into the underground material;

forming one or more slot cavities in the one or more substantially vertical collector well bores for collecting fluid drained from the subterranean zone, wherein the one or more slot cavities comprise a substantially noncylindrical shape;

providing a solution into the one or more substantially vertical driver well bores to drive the fluid through the material and into the one or more slot cavities; and retrieving the fluid from the one or more slot cavities.

24. The method of claim 23, wherein retrieving the fluid from the one or more slot cavities comprises pumping the fluid from the one or more slot cavities through the one or more substantially vertical collector well bores.

25. The method of claim 23, wherein the fluid comprises a pollutant.

26. A system for retrieval of subsurface fluid, comprising:

one or more substantially vertical driver well bores extending from the surface into an underground material, wherein the underground material includes a fluid;

one or more substantially vertical collector well bores extending from the surface into the underground material;

one or more slot cavities formed in the one or more substantially vertical collector well bores for collecting fluid drained from the subterranean zone, wherein the one or more slot cavities comprise a substantially non-cylindrical shape; and wherein the one or more substantially vertical driver well bores include a solution provided to drive the fluid through the material and into the one or more slot cavities.

27. The system of claim 26, wherein the fluid comprises a pollutant.

* * * * *